US008749457B2

(12) United States Patent
Segawa et al.

(10) Patent No.: US 8,749,457 B2
(45) Date of Patent: Jun. 10, 2014

(54) ORGANIC ELECTROLUMINESCENCE DISPLAY DEVICE MANUFACTURING METHOD AND ORGANIC ELECTROLUMINESCENCE DISPLAY DEVICE

(75) Inventors: Yasuo Segawa, Hyogo (JP); Tetsurou Nakamura, Kyoto (JP); Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 303 days.

(21) Appl. No.: 13/403,489

(22) Filed: Feb. 23, 2012

(65) Prior Publication Data

US 2012/0147070 A1 Jun. 14, 2012

Related U.S. Application Data

(63) Continuation of application No. PCT/JP2010/002475, filed on Apr. 5, 2010.

(51) Int. Cl.
*G09G 3/32* (2006.01)

(52) U.S. Cl.
USPC ..... 345/77; 345/694; 345/76; 345/82; 345/690; 345/204; 315/169.3; 313/463

(58) Field of Classification Search
CPC ..... G09G 2320/04; G09G 2320/041; G09G 2320/043; G09G 2320/045; G09G 2320/046; G09G 2320/048
USPC ..... 345/76–83, 690–694, 204; 313/463–464, 483–512; 315/169.3
See application file for complete search history.

(56) References Cited

U.S. PATENT DOCUMENTS 6,473,065 B1 * 10/2002 Fan ..... 345/82
7,329,849 B2 2/2008 Kasai
7,719,492 B2 5/2010 Childs (Continued)

FOREIGN PATENT DOCUMENTS

JP 2003-075794 3/2003
JP 2005-284172 10/2005

(Continued)

OTHER PUBLICATIONS

International Search Report in PCT/JP2010/002475, dated Apr. 27, 2010.

(Continued)

*Primary Examiner* — Lun-yi Lao
*Assistant Examiner* — Saiful A Siddiqui
(74) *Attorney, Agent, or Firm* — Greenblum & Bernstein, P.L.C.

(57) ABSTRACT

A method of manufacturing an organic electroluminescence display includes preparing a substrate including pixels. The pixels each include a drive transistor and a capacitor. The capacitor of a subject pixel is caused to hold a voltage which corresponds to a threshold voltage of the drive transistor, and the voltage is read. A first signal voltage is obtained by adding a first correction parameter of the subject pixel to a second signal voltage corresponding to a single gradation level belonging to an intermediate gradation region or a high gradation region of representative voltage-luminance characteristics. The first signal voltage is applied to the driver of the subject pixel, and a luminance emitted by the subject pixel is measured. A second correction parameter with which the luminance emitted by the subject pixel becomes a standard luminance is calculated.

16 Claims, 20 Drawing Sheets

(56) References Cited

U.S. PATENT DOCUMENTS

| | | | | |
|---|---|---|---|---|
| 7,834,825 | B2 | 11/2010 | Mizukoshi et al. | |
| 7,839,457 | B2 | 11/2010 | Yamagata et al. | |
| 7,859,492 | B2 | 12/2010 | Kohno | |
| 7,907,137 | B2 | 3/2011 | Shirasaki et al. | |
| 7,982,695 | B2 | 7/2011 | Mizukoshi et al. | |
| 8,026,927 | B2 | 9/2011 | Daly et al. | |
| 8,059,070 | B2 | 11/2011 | Odawara et al. | |
| 2006/0066530 | A1* | 3/2006 | Azami et al. | 345/76 |
| 2006/0221015 | A1 | 10/2006 | Shirasaki et al. | |
| 2006/0231740 | A1 | 10/2006 | Kasai | |
| 2006/0284802 | A1 | 12/2006 | Kohno | |
| 2007/0008251 | A1 | 1/2007 | Kohno et al. | |
| 2007/0070085 | A1 | 3/2007 | Yamagata et al. | |
| 2007/0164959 | A1 | 7/2007 | Childs | |
| 2007/0210996 | A1 | 9/2007 | Mizukoshi et al. | |
| 2008/0238934 | A1 | 10/2008 | Daly et al. | |
| 2009/0256854 | A1 | 10/2009 | Mizukoshi et al. | |
| 2010/0007645 | A1* | 1/2010 | Ono | 345/211 |
| 2010/0253715 | A1* | 10/2010 | Odawara et al. | 345/690 |

FOREIGN PATENT DOCUMENTS

| | | |
|---|---|---|
| JP | 2006-284716 | 10/2006 |
| JP | 2006-301159 | 11/2006 |
| JP | 2006-349966 | 12/2006 |
| JP | 2007-018876 | 1/2007 |
| JP | 2007-122013 | 5/2007 |
| JP | 2007-519956 | 7/2007 |
| JP | 2008-250319 | 10/2008 |
| JP | 2008-287179 | 11/2008 |
| JP | 2009-258302 | 11/2009 |
| WO | 2005/069267 | 7/2005 |
| WO | 2005/101360 | 10/2005 |
| WO | 2006/104259 | 10/2006 |
| WO | 2009/144936 | 12/2009 |

OTHER PUBLICATIONS

U.S. Appl. No. 13/403,375 to Yasuo Segawa et al., which was filed on Feb. 23, 2012.

* cited by examiner

FIG. 11

43a

| | | | |
|---|---|---|---|
| (G11, OS11) | (G12, OS12) | ... | (G1n, OS1n) |
| (G21, OS21) | (G22, OS22) | ... | (G2n, OS2n) |
| (G31, OS31) | (G32, OS32) | ... | (G3n, OS3n) |
| ⋮ | ⋮ | ⋮ | ⋮ |
| (Gm1, OSm1) | (Gm2, OSm2) | ... | (Gmn, OSmn) |

ORGANIC ELECTROLUMINESCENCE DISPLAY DEVICE MANUFACTURING METHOD AND ORGANIC ELECTROLUMINESCENCE DISPLAY DEVICE

CROSS REFERENCE TO RELATED APPLICATION

This is a continuation application of PCT Application No. PCT/JP2010/002475 filed on Apr. 5, 2010, designating the United States of America, the disclosure of which, including the specification, drawings and claims, is incorporated herein by reference in its entirety.

BACKGROUND OF THE INVENTION

1. Field of the Invention

The present invention relates to an organic electroluminescence (EL) display device manufacturing method and to an organic EL display device.

2. Description of the Related Art

Image display devices (organic EL displays) using organic electroluminescence elements (OLED: Organic Light-Emitting Diodes) are well-known as image display devices using current-driven light-emitting elements. Due to such advantages as excellent viewing angle characteristics and low power consumption, such organic EL displays have gained much attention as candidates for next-generation flat panel displays (FPDs).

In organic EL display devices, organic EL elements included in pixels are normally arranged in a matrix. In an organic EL display referred to as a passive-matrix organic EL display, an organic EL element is provided at each crosspoint between row electrodes (scanning lines) and column electrodes (data lines), and such organic EL elements are driven by applying a voltage equivalent to a data signal, between a selected row electrode and the column electrodes.

On the other hand, in an organic EL display device referred to as an active-matrix organic EL display, a thin film transistor (TFT) is provided in each crosspoint between scanning lines and data lines, the gate of a drive transistor is connected to the TFT, the TFT is turned ON through a selected scanning line so as to input a data signal from a data line to the drive transistor, and an organic EL element is driven by such drive transistor.

Unlike in the passive-matrix organic EL display where, only during the period in which each of the row electrodes (scanning lines) is selected, does the organic EL element connected to the selected row electrode emit light, in the active-matrix organic EL display, it is possible to cause the organic EL element to emit light until a subsequent scan (selection), and thus a reduction in display luminance is not incurred even when the number of scanning lines increases. Therefore, since driving with low voltage is possible, reduction of power consumption becomes possible. However, in the active-matrix organic EL display, due to variation in the characteristics of drive transistors and organic EL elements arising in the manufacturing process, the luminance of the organic EL elements are different among the respective pixels even when the same data signal is supplied, and thus there are instances where luminance unevenness, such as a band or unevenness, occurs.

In response, there is proposed a correction method of correcting bands and unevenness occurring in an organic EL display in which, by correcting an image signal (data signal), the luminance of the organic EL elements corresponding to the image signal supplied to the respective pixels can be corrected to a predetermined standard luminance (for example, Patent Reference 1: Unexamined Japanese Patent Application Publication No. 2005-284172).

In the correction method of Patent Reference 1, by measuring the luminance distribution or current distribution of at least three gradation levels in each pixel of an organic EL display, it is possible to obtain the gain and offset which are correction parameters for correcting the luminance of the organic EL element corresponding to the image signal supplied to the respective pixels to a predetermined standard luminance.

However, the conventional correction methods have the problems described below.

Conventionally, as a correction method, there is for example a method of obtaining gain and offset, which are correction parameters, using the least-square technique. In this method which uses the least-square technique, multi-gradation level luminance measurement is performed for each pixel, and the gain and offset are obtained using a predetermined calculation method, based on the luminance difference between the luminance of each pixel obtained in each measurement and the representative voltage-luminance characteristics. As an example, luminance L1 to L6 at the six points of voltages V1 to V6 is measured for a certain pixel using the least-square technique, and V×1 to V×6 are obtained as the correction parameters, as shown in FIG. 1.

However, in the correction method which uses the least-square method for example, by nature it is necessary to perform the luminance measurement on each pixel for a number of gradation levels that is at least 3 gradation levels and preferably 5 gradation levels or more, and thus there is the problem of requiring time from the performance of the luminance measurement for each pixel up to the obtainment of the correction parameters. In particular, a very long time is required for the luminance measurement in the low gradation-side. As a result, there is the problem that measurement tact from the performance of the luminance measurement for each pixel up to the obtainment of the correction parameters becomes long.

Furthermore, in an organic EL display, there is a tendency for the occurrence of streaky luminance unevenness and so on in the low gradation regions. The human eye recognizes luminance differences more easily in the low gradation-side than in the high gradation-side. As such, it is preferable that correction precision be higher for the low gradation-side than the high gradation-side. However, normally, the luminance difference between the representative voltage-luminance characteristics and the voltage-luminance characteristics of each pixel increases as one goes further into the high gradation-side, and since the least-square method simultaneously obtains the gain and offset by calculation so that the luminance error in the high gradation-side is minimized, there is the problem that, although the correction error in the high gradation-side can be minimized, the correction error in the low gradation-side becomes big compared to that in the high gradation-side.

SUMMARY OF THE INVENTION

The present invention is conceived in view of the above-described circumstances and has as an object to provide an organic EL display device manufacturing method and an organic EL display device which can shortening the measurement tact from the performance of luminance measurement for each pixel to the obtainment of the correction parameter.

In order to achieve the aforementioned object, a method of manufacturing an organic electroluminescence (EL) display device according to the present invention is a method of manufacturing an organic electroluminescence (EL) display device which includes a display panel and stores a correction parameter in a predetermined storage unit used for the display panel, the method including: preparing a circuit substrate including pixel units each of which includes a drive element which is voltage driven and a capacitor which has a first electrode connected to a gate electrode of the drive element and a second electrode connected to a source electrode of the drive element; causing the capacitor included in a subject pixel unit to hold a corresponding-voltage which is a voltage that corresponds to a threshold voltage of the drive element, and reading the corresponding-voltage held by the capacitor included in the subject pixel unit, using a first measuring device, the subject pixel unit being a current pixel unit to be processed among the pixel units included in the display panel; storing, using the first measuring device, the read corresponding-voltage as a first correction parameter of the subject pixel unit, in the storage unit used for the display panel; preparing the display panel which includes the circuit substrate and light-emitting elements by which corresponding ones of the pixel units included in the circuit substrate emit light according to a drive current of the drive element; obtaining representative voltage-luminance characteristics common among the pixel units included in the display panel; obtaining a predetermined signal voltage by adding the first correction parameter of the subject pixel unit to a signal voltage corresponding to a single gradation level belonging to one of an intermediate gradation region and a high gradation region of the representative voltage-luminance characteristics; applying the predetermined signal voltage to the drive element included in the subject pixel unit, and measuring a luminance emitted by the subject pixel unit using a second measuring device; calculating a second correction parameter with which the luminance of the subject pixel unit measured in the applying becomes a standard luminance obtained when the predetermined signal voltage is inputted to a function of the representative voltage-luminance characteristics; and storing the calculated second correction parameter in the predetermined storage unit, in association with the subject pixel unit, wherein in the calculating, a voltage such that the luminance of light emitted by the subject pixel unit is the standard luminance is calculated, and the second correction parameter is a gain indicating a ratio between the predetermined signal voltage and the calculated voltage.

According to the present invention, it is possible to realize an organic EL display device and a manufacturing method thereof which can shorten the measuring tact, from when the luminance measurement for each pixel is performed up to when the correction parameter is obtained. Specifically, aside from being able to determine the external correction parameter using only the two measurements of the Vt measurement of the TFT substrate and the luminance measurement in one gradation level, luminance measurement is performed only in the one-time measurement for the high luminance portion. With this, luminance measurement tact can be shortened, and measurement tact can be made extremely short.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings:

FIG. 11 is a table showing an example of a correction parameter table held by a storage unit in the present embodiment;

DESCRIPTION OF THE PREFERRED EMBODIMENT(S)

Figure 1:
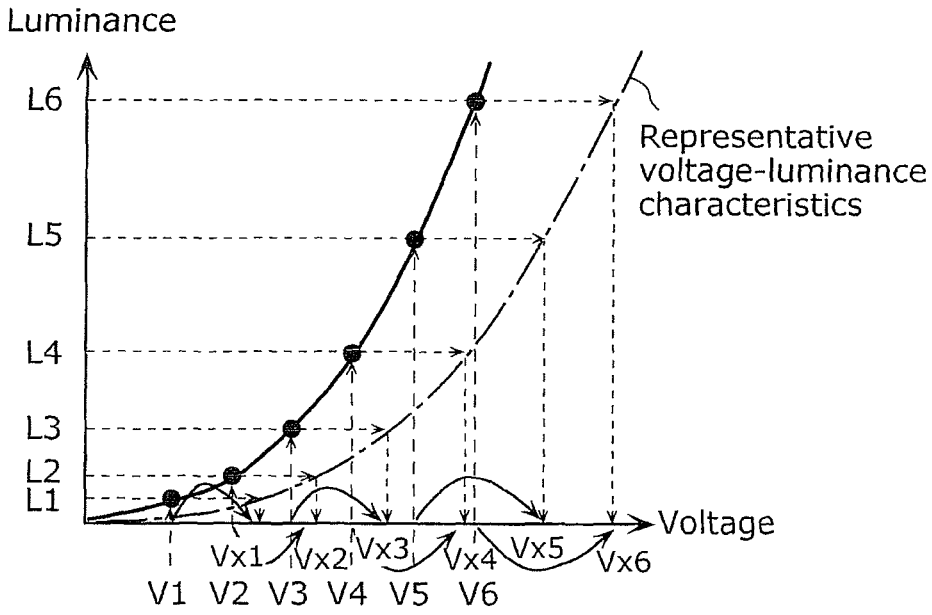
PRIOR ART FIG. 1
FIG. 1 is a diagram for describing a conventional method of calculating a correction parameter.

A method of manufacturing an organic electroluminescence (EL) display device according to a first aspect is a method of manufacturing an organic electroluminescence (EL) display device which includes a display panel and stores a correction parameter in a predetermined storage unit used for the display panel, the method including: preparing a circuit substrate including pixel units each of which includes a drive element which is voltage driven and a capacitor which has a first electrode connected to a gate electrode of the drive element and a second electrode connected to a source electrode of the drive element; causing the capacitor included in a subject pixel unit to hold a corresponding-voltage which is a voltage that corresponds to a threshold voltage of the drive element, and reading the corresponding-voltage held by the capacitor included in the subject pixel unit, using a first measuring device, the subject pixel unit being a current pixel unit to be processed among the pixel units included in the display panel; storing, using the first measuring device, the read corresponding-voltage as a first correction parameter of the subject pixel unit, in the storage unit used for the display panel; preparing the display panel which includes the circuit substrate and light-emitting elements by which corresponding ones of the pixel units included in the circuit substrate emit light according to a drive current of the drive element; obtaining representative voltage-luminance characteristics common among the pixel units included in the display panel; obtaining a predetermined signal voltage by adding the first correction parameter of the subject pixel unit to a signal voltage corresponding to a single gradation level belonging to one of an intermediate gradation region and a high gradation region of the representative voltage-luminance characteristics; applying the predetermined signal voltage to the drive element included in the subject pixel unit, and measuring a luminance emitted by the subject pixel unit using a second measuring device; calculating a second correction parameter with which the luminance of the subject pixel unit measured in the applying becomes a standard luminance obtained when the predetermined signal voltage is inputted to a function of the representative voltage-luminance characteristics; and storing the calculated second correction parameter in the predetermined storage unit, in association with the subject pixel unit, wherein in the calculating, a voltage such that the luminance of light emitted by the subject pixel unit is the standard luminance is calculated, and the second correction parameter is a gain indicating a ratio between the predetermined signal voltage and the calculated voltage.

According to the present invention, first, the capacitor included in the pixel (pixel unit) is caused to hold the threshold voltage of the drive element, and the corresponding-voltage that corresponds to the threshold voltage held by the capacitor is calculated using the first measuring device. Then, the calculated corresponding-voltage that corresponds to the threshold voltage is stored, as the first correction parameter of the pixel, in the predetermined storage unit used for the display panel. Accordingly, since the above-described luminance difference in the low gradation-side affects the variation in the threshold voltage of the drive elements, using the corresponding-voltage as the correction parameter allows the luminance emitted by the respective pixels to be matched with the representative voltage-luminance characteristics in the low gradation region.

Next, the predetermined voltage obtained by adding the first correction parameter to the signal voltage corresponding to one gradation level belonging to the intermediate gradation region or the high gradation region is calculated, and luminance measurement is performed for the first time by applying the predetermined voltage to the drive element included in the pixel. More specifically, by adding the first correction parameter, which is the corresponding-voltage that corresponds to the threshold value of the drive element, to the signal voltage corresponding to the one gradation level belonging to the intermediate gradation region or the high gradation region, the luminance measurement in the intermediate gradation region or the high gradation region can be performed with the luminance in the low gradation region matching the representative voltage-luminance characteristics.

Subsequently, the second correction parameter with which the luminance of the pixel becomes the standard luminance obtained when the predetermined voltage is inputted to the function of the representative voltage-luminance characteristics is calculated for the pixel.

In this manner, the corresponding voltage that corresponds to the threshold voltage of the drive element is read and used as the first correction parameter, and the luminance of the respective pixels in the high gradation region is matched with the luminance indicated by the representative voltage-luminance characteristics in the state where the luminance in the low gradation region matches the representative voltage-luminance characteristics, and thus the emitted luminance in the two gradation levels of the predetermined one gradation level belonging to the low gradation region and the predetermined one gradation level belonging to another gradation region can be made to match the representative voltage-luminance characteristics. As a result, since the luminance variation of the display panel that is recognizable by the human eye can be suppressed and it is possible to arbitrarily select one gradation level on which to perform luminance measurement, it is possible to suppress luminance unevenness in a desired gradation region other than the low gradation region.

Furthermore, since the first correction parameter can be calculated in one measurement and the second correction parameter can be calculated in one luminance measurement, the first correction parameter and the second correction parameter can be calculated in a total of two measurements. As a result, the measurement tact from the performance of the luminance measurement for each pixel up to the obtainment of the correction parameters can be shortened.

In an organic EL display device according to a second aspect, in the calculating, a voltage such that the luminance of light emitted by the subject pixel unit is the standard luminance is calculated, and the second correction parameter is a gain indicating a ratio between the predetermined signal voltage and the calculated voltage.

In an organic EL display device according to a third aspect, the second correction parameter is a gain indicating a ratio between the luminance when the subject pixel is caused to emit light according to the predetermined signal voltage and the standard luminance.

In an organic EL display device according to a fourth aspect, the second electrode of the capacitor is connected to the source electrode of the drive element, each of the pixel units further includes: a first power line for determining a potential of a drain electrode of the drive element; a second power line connected to a second electrode of the light emitting element; a third power line for supplying a first standard voltage which defines a voltage value of the first electrode of the capacitor; a data line for supplying a signal voltage; a first switching element which switches between conduction and non-conduction between the first electrode of the capacitor and the third power line; a second switching element which has one of terminals connected to the data line and the other of the terminals connected to the second electrode of the capacitor, and which switches between conduction and non-conduction between the data line and the second electrode of the capacitor; a third switching element which has one of terminals connected to the source electrode of the drive element and the other of the terminals connected to the second electrode of the capacitor, and which switches between conduction and non-conduction between the source electrode of the drive element and the second electrode of the capacitor, and in the causing: a potential difference that is larger than the threshold voltage of the drive element is generated in the capacitor by placing the first switching element in an ON state to apply the first standard voltage to the first electrode of the capacitor and placing the second switching element in the ON state to apply, from the data line, a second standard voltage that is lower than a value obtained by subtracting the threshold voltage of the drive element from the first standard voltage; and the capacitor is caused to hold the corresponding-voltage that corresponds to the threshold voltage by allowing passage of time up to when the potential difference in the capacitor reaches the threshold voltage of the drive element and the drive element turns OFF.

According to the present aspect, it is possible to cause the capacitor to hold the corresponding-voltage that corresponds to the threshold voltage of the drive element.

In a method of manufacturing an organic EL display device according to a fifth aspect, the first power line and the third power line are a common power line.

According to the present aspect, the first power line and the second power line can be combined into a common power line when performing the measurement of the corresponding-voltage that corresponds to the threshold voltage of the drive element in the case where the light-emitting element is not provided in the respective pixel units.

In a method of manufacturing an organic EL display device according to a sixth aspect, in the preparing of a circuit substrate, the display panel is prepared in place of the circuit substrate.

According to the present aspect, the measurement of the voltage corresponding to the threshold voltage may be performed by providing the light-emitting element in the respective pixel units.

In an organic EL display device according to a seventh aspect, in the causing, a voltage value of the first standard voltage is set so that a potential difference between a first electrode and a second electrode of the light-emitting element when the first standard voltage is applied to the first electrode of the capacitor is a voltage lower than a threshold voltage of the light-emitting element at which the light-emitting element starts to emit light.

According to the present aspect, the voltage value of the first standard-voltage is set so that, in the case where the corresponding-voltage that corresponds to the threshold voltage is to be measured in the capacitor in the state where the light-emitting element is provided in each of the pixel units of the circuit substrate, the light-emitting element does not emit light when the first standard-voltage is applied to the first electrode of the capacitor.

In a method of manufacturing an organic EL display device according to an eighth aspect, in the causing: a current corresponding to the corresponding-voltage is supplied from the second electrode of the capacitor to a data line, by placing a second switching element in an ON state after causing the capacitor to hold the corresponding-voltage that corresponds to the threshold voltage; and the corresponding-voltage held by the capacitor is read by measuring, using the first measuring device, the current supplied to the data line.

According to the present aspect, the second switching element is placed in the ON state after the capacitor is caused to hold the corresponding-voltage that corresponds to the threshold voltage, thereby supplying the current corresponding to the voltage held by the capacitor to the data line. Then, the current supplied to the data line is measured using the first measuring device. With this, the voltage held by the capacitor can be read based on the current measured using the first measuring device.

In an organic EL display device according to a ninth aspect, the corresponding-voltage that corresponds to the threshold voltage is a voltage having a voltage value that is proportional to a voltage value of the threshold voltage and smaller than the voltage value of the threshold voltage.

According to the present aspect, the corresponding-voltage that corresponds to the threshold voltage is a voltage having a voltage value that is proportional to the voltage value of the threshold voltage and is smaller than the voltage value of the threshold voltage.

In this manner, the value of the voltage to be read is not the value of the threshold value but a voltage value that is smaller than the voltage value because the low gradation region of representative voltage-luminance characteristics corresponds to a region showing a voltage that is smaller than the threshold voltage. By reading a voltage having a value smaller than the threshold value and using this as the first correction parameter, the correction precision in the high gradation region of the representative voltage-luminance characteristics can be enhanced.

In an organic EL display device according to a tenth aspect, the signal voltage corresponding to the single gradation level belonging to the high gradation region of the representative voltage-luminance characteristics is a voltage corresponding to a gradation level that is 20% to 100% of a maximum gradation level that can be displayed by each of the pixel units.

According to the present aspect, a voltage corresponding to one gradation level that is 20% to 100% of the maximum gradation level is applied as the signal voltage corresponding to one gradation level belonging to the high gradation region of the representative voltage-luminance characteristics.

In an organic EL display device according to an eleventh aspect, the signal voltage that corresponds to the single gradation level belonging to the high gradation region of the representative voltage-luminance characteristics is a voltage corresponding to a gradation level that is 30% of a maximum gradation level that can be displayed by each of the pixel units.

According to the present aspect, a voltage corresponding to a gradation level that is 30% of the maximum gradation level is applied as the signal voltage corresponding to one gradation level belonging to the high gradation region of the representative voltage-luminance characteristics. This case allows for maximum suppression of correction error in the high gradation region.

In an organic EL display device according to a twelfth aspect, the signal voltage that corresponds to the single gradation level belonging to the intermediate gradation region of the representative voltage-luminance characteristics is a voltage corresponding to a gradation level that is 10% to 20% of a maximum gradation level that can be displayed by each of the pixel units.

According to the present aspect, a voltage corresponding to one gradation level belonging to a gradation region that is 10% to 20% of the maximum gradation level is applied as the signal voltage corresponding to one gradation level belonging to the intermediate gradation region of the representative voltage-luminance characteristics.

In an organic EL display device according to a thirteenth aspect, the representative voltage-luminance characteristics are voltage-luminescence characteristics of a predetermined single pixel unit among the pixel units included in the display panel.

According to the present aspect, the representative voltage-luminance characteristics may be set as the voltage-luminance characteristics of a single arbitrary pixel unit among the pixel units included in the display panel.

In an organic EL display device according to a fourteenth aspect, the representative voltage-luminance characteristics are characteristics obtained by averaging voltage-luminescence characteristics of two or more pixel units among the pixel units included in the display panel.

According to the present aspect, the representative voltage-luminance characteristics are set in common throughout the entire display panel including the pixels, and can be calculated by averaging the voltage-luminance characteristics of the respective pixels included in the display panel. With this, since the correction parameter is calculated so that the luminance of each of the pixels included in the display panel becomes the representative voltage-luminance characteristics common throughout the entire display panel, using such correction parameter to correct the image signal allows the luminance of the light emitted by the respective pixels to be evened-out.

In an organic EL display device according to a fifteenth aspect, in the obtaining representative voltage-luminance characteristics, the display panel is divided into segments, and the representative voltage-luminance characteristics are set for each of the segments, the representative voltage-luminance characteristics being common among the pixel units included in each of the segments, and in the calculating, the second correction parameter with which the luminance emitted when the subject pixel unit is caused to emit light according to the predetermined signal voltage becomes a standard luminance is calculated for the subject pixel unit, the standard luminance being obtained when the predetermined signal voltage is inputted to the function of the representative voltage-luminance characteristics for the segment including the subject pixel unit.

According to the present aspect, the display panel is divided into segments, and representative voltage-luminance characteristics common among the pixels included in each of the segments are set on a per segment basis. Subsequently, the second correction parameter is calculated so that the luminance when the pixel is caused to emit light according to the predetermined signal voltage becomes the luminance obtained when the predetermined signal voltage is inputted to the function of the representative voltage-luminance characteristics for the segment including the pixel.

With this, it is possible, for example, to correct only a segment in which luminance unevenness occurs because luminance change between adjacent pixels is severe, and thus it is possible to calculate a correction parameter with which the luminance change between the adjacent pixels becomes smooth.

In an organic EL display device according to a sixteenth aspect, the first measuring device is an array tester.

In an organic EL display device according to a seventeenth aspect, the second measuring device is an image sensor.

An organic EL element according to an eighteenth aspect includes: a display panel including pixel units each of which includes a light-emitting element, a drive element which is voltage-driven and controls supply of current to the light-emitting element, and a capacitor which has a first electrode connected to a gate electrode of the drive element and a second electrode connected to one of a source electrode and a drain electrode of the drive element; a storage unit configured to store, for each of the pixel units, a correction parameter for correcting, in accordance with characteristics of the pixel unit, an image signal inputted from an external source; and a control unit configured to obtain, for each of the pixel units, a corrected signal voltage by reading, from the storage unit, the correction parameter corresponding to the pixel unit and calculating the corrected signal from the image signal corresponding to the pixel unit using the read correction parameter, wherein the correction parameter is generated by: causing the capacitor included in a subject pixel unit to hold a corresponding-voltage that corresponds to a threshold voltage of the drive element, and reading the corresponding-voltage held by the capacitor included in the subject pixel unit, using a first measuring device, the subject pixel unit being a current pixel unit to be processed among the pixel units included in the display panel; storing the read corresponding-voltage as a first correction parameter of the subject pixel unit, in the storage unit, using the first measuring device; obtaining representative voltage-luminance characteristics common among the pixel units included in the display panel; obtaining a predetermined signal voltage by adding the first correction parameter of the subject pixel unit to a signal voltage corresponding to a single gradation level belonging to one of an intermediate gradation region and a high gradation region of the representative voltage-luminance characteristics; applying the predetermined signal voltage to the drive element included in the subject pixel unit, and measuring a luminance emitted by the subject pixel unit using a second measuring device; calculating a second correction parameter with which the luminance of the subject pixel unit measured in the applying becomes a standard luminance obtained when the predetermined signal voltage is inputted to the representative voltage-luminance characteristics; and storing the calculated second correction parameter in the storage unit, in association with the subject pixel unit, wherein in the calculating, a voltage such that the luminance of light emitted by the subject pixel is the standard luminance is calculated, and the second correction parameter is a gain indicating a ratio between the predetermined signal voltage and the calculated voltage.

Embodiment

Hereinafter, an embodiment of the present invention shall be described with reference to the Drawings.

Figure 2:
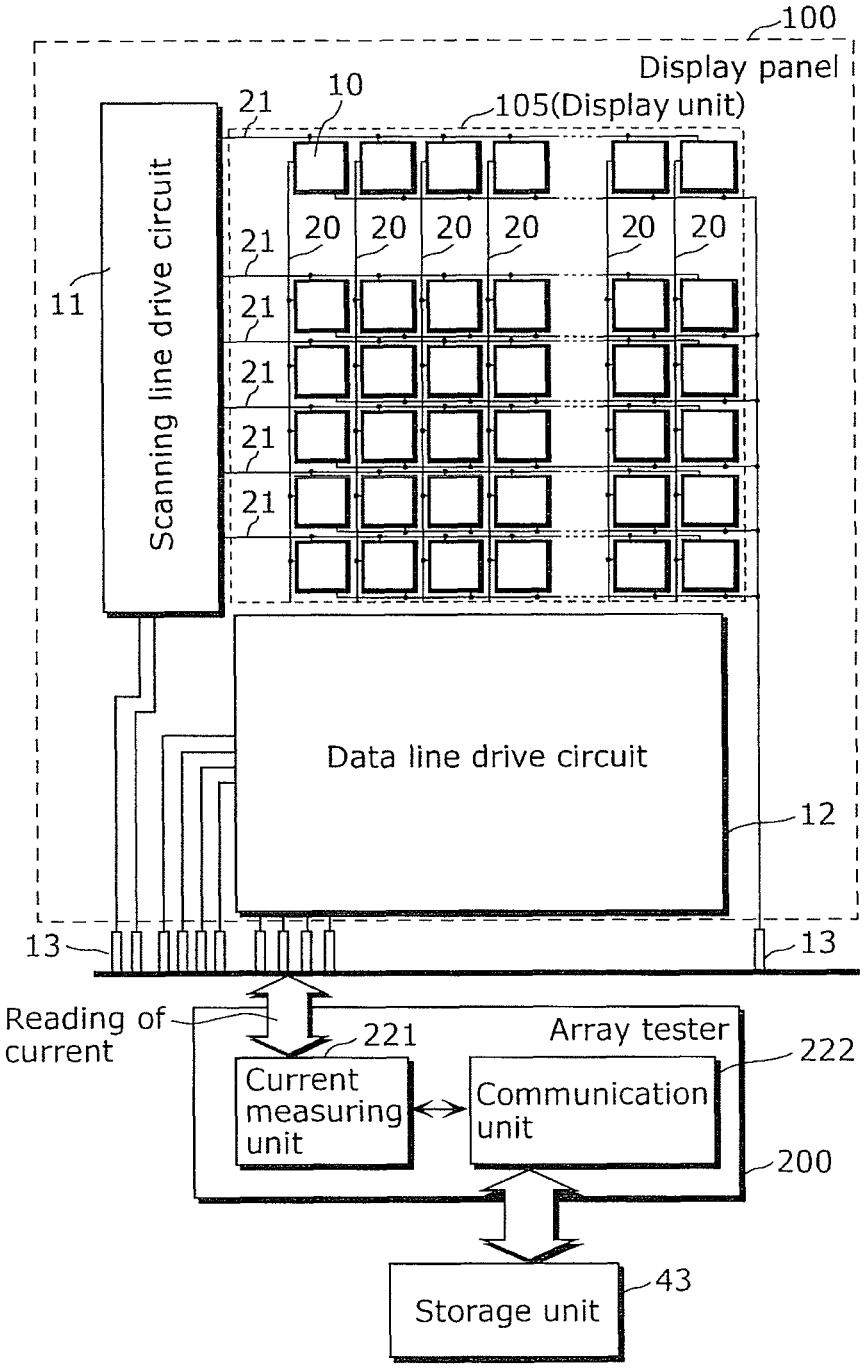
FIG. 2 is a block diagram showing a configuration of a forward circuit substrate assembled as a display panel and an array tester which measures the circuit substrate.
Figure 3:
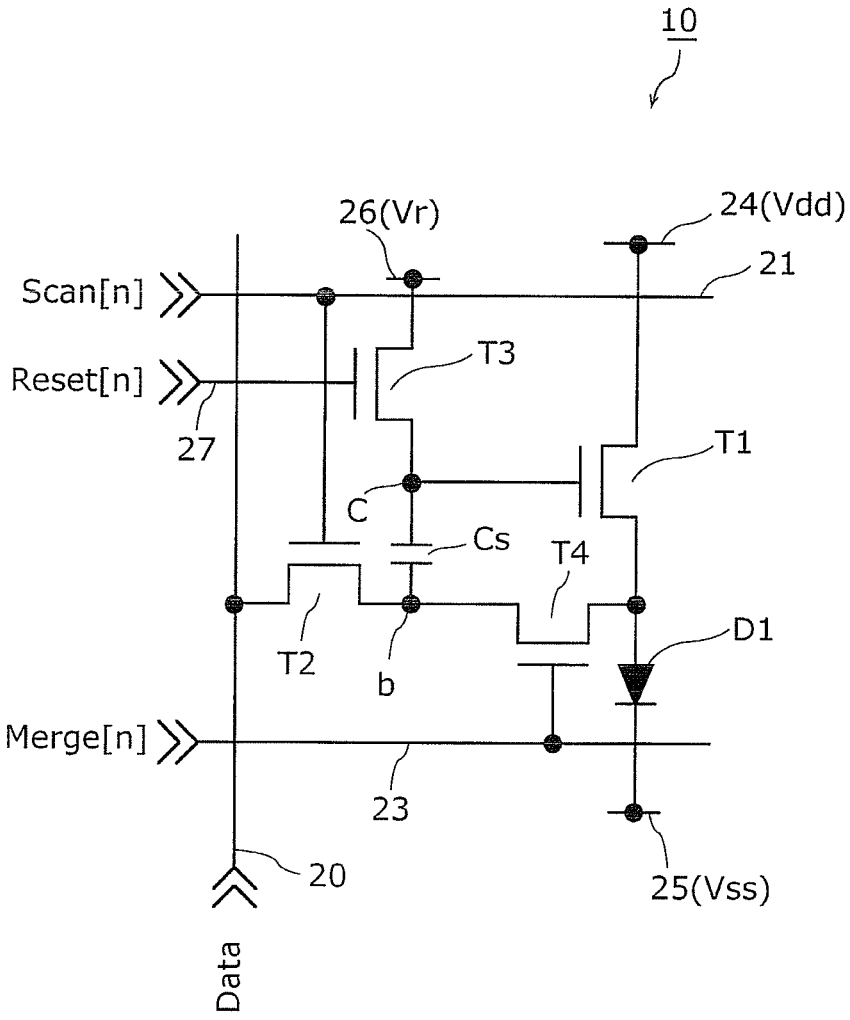
FIG. 3 is a diagram showing a circuit configuration of one pixel unit included in a display unit.

FIG. 2 is a block diagram showing a configuration of a forward circuit substrate assembled as a display panel and an array tester 200 which measures the circuit substrate. FIG. 3 is a diagram showing a circuit configuration of one pixel unit 10 included in a display unit 105.

The circuit substrate shown in FIG. 2 includes organic EL elements D1 and is assembled in a display panel 100 of an organic EL display device. The display unit 105, a scanning line drive circuit 11, a data line drive circuit 12, and input and output terminals 13 are formed on this circuit substrate.

The display unit 105 includes pixel units 10 which are arranged in m rows×n columns, and displays images based on an image signal which is a luminance signal inputted to the organic EL display device from an external source. Here, the circuit configuration of a pixel unit 10 shall be described in detail with reference to the Drawings.

As shown in FIG. 3, the pixel unit 10 includes an organic EL element D1 which is a an element that emits light upon application of current, a drive transistor T1, a switching transistor T2, a holding capacitor Cs, a reference transistor T3, and a isolation transistor T4. Furthermore, the following are connected to the pixel unit 10: a scanning line 21; a data line 20 for supplying signal voltage; a merge line 23; a high-voltage-side power line 24 for determining the potential of a drain electrode of the drive transistor T1; the low-voltage-side power line 25 which is connected to a second electrode of the organic EL element D1; a standard-voltage power line 26 for supplying a first standard voltage which defines the voltage value of a first electrode of the holding capacitor Cs; and a reset line 27.

The organic EL element D1 functions as a light-emitting element, and emits light according to the drive current of the drive transistor T1. The organic EL element D1 has a cathode connected to the low-voltage-side power line 25, and an anode connected to a source of the drive transistor T1. Here, the voltage supplied to the low-voltage-side power line 25 is denoted by Vss, and is for example 0 (v). It should be noted that although the organic EL element D1 is included in the pixel unit 10 in FIG. 3, in the state of the forward circuit substrate assembled as the display panel, the pixel unit 10 need not include the organic EL element D1.

The drive transistor T1 is a voltage-driven drive element which causes the organic EL element D1 to emit light by providing current to the organic EL element D1. The drive transistor T1 has a gate connected to the data line 20 via the holding capacitor CS and the switching transistor T2, a source connected to an anode of the organic EL element D1, and a drain connected to the high-voltage-side power line 24. Here, the voltage supplied to the high-voltage-side power line 24 is denoted as Vdd, and is, for example, 20 (v). With this, the drive transistor T1 converts the signal voltage (data signal Data) supplied to its gate into a signal current corresponding to the signal voltage (data signal Data), and supplies the signal current obtained from the conversion to the organic EL element D1.

The holding capacitor Cs has a function of holding a signal voltage which determines the amount of current to be supplied by the drive transistor T1. Specifically, the holding capacitor Cs is electrically connected between the source (low-voltage-side power line 25) of the drive transistor T1 and the gate of the drive transistor T1. Stated differently, the holding capacitor Cs has a first electrode connected to the gate electrode of the drive transistor T1 and a second electrode connected to the source electrode of the drive transistor T1 via the isolation transistor T4. The holding capacitor Cs has, for example, a function of maintaining the immediately preceding signal voltage and causing drive current to be continuously supplied from the drive transistor T1 to the organic EL element D1, even after the switching transistor T2 switches to the OFF state. It should be noted that, in actuality, the holding capacitor Cs holds an electric charge obtained by multiplying a signal voltage by a capacitance.

The switching transistor T2 has one terminal connected to the data line 20 and the other terminal connected to the second electrode of the holding capacitor Cs, and switches between conduction and non-conduction between the data line 20 and the holding capacitor Cs. Specifically, the switching transistor T2 has a function for writing, in the holding capacitor Cs, a signal voltage (data signal Data) that is in accordance with the image signal. The switching transistor T2 has a gate connected to the scanning line 21, and one of a source and a drain connected to the data line 20. In addition, the switching transistor T2 has a function of controlling the timing for supplying the signal voltage (data signal Data) of the data line 20 to the gate of the drive transistor T1.

The reference transistor T3 switches between conduction and non-conduction between the first electrode of the holding capacitor Cs and the standard-voltage power line 26. Specifically, the reference transistor T3 has a function of providing a standard voltage (Vr) to the gate of the drive transistor T1, during the detection of a threshold voltage Vth of the drive transistor T1. The reference transistor T3 has one of a drain and a source connected to the gate of the drive transistor T1, and the other of the drain and the source connected to the standard-voltage power line 26 for applying the reference voltage (Vr). Furthermore, the reference transistor T3 has a gate connected to the reset line 27.

The isolation transistor T4 has one terminal connected to the source electrode of the drive transistor T1 and the other terminal connected to the second electrode of the holding capacitor Cs, and switches between conduction and non-conduction between the source electrode of the drive transistor T1 and the second electrode of the holding capacitor Cs. Specifically, the isolation transistor T4 has a function of isolating the holding capacitor Cs from the drive transistor T1 during a write period in which voltage is written into the holding capacitor Cs. The isolation transistor T4 has one of a drain and a source connected to the source of the drive transistor T1, and the other of the drain and the source connected to the second electrode of the holding capacitor Cs. Furthermore, the isolation transistor T4 has a gate connected to the merge line 23.

It should be noted that each of the drive transistor T1, the switching transistor T2, the reference transistor T3, and the isolation transistor T4 is, for example, an N-channel thin-film transistor or an enhancement transistor. Of course, these transistors may be channel thin-film transistors, or depression transistors.

The pixel unit 10 is configured as described above. Description shall be continued returning to FIG. 2.

The scanning line drive circuit 11 is connected to the scanning line 21 and has a function of controlling the conduction and non-conduction to the switching transistor T2 of the pixel unit 10. Specifically, the scanning line drive circuit 11 supplies a scanning signal Scan to each of the pixel units 10 arranged in the row direction in FIG. 2 via the scanning line 21 connected in common to such pixel units 10.

The data line drive circuit 12 is connected to the data lines 20, and has a function of outputting the signal voltage (data signal Data) that is in accordance with the image signal, and determining the signal current that flows to the drive transistor T1. Specifically, the data line drive circuit 12 supplies the signal voltage (data signal Data) to each of the pixel units 10 arranged in the column direction in FIG. 2 via the data line 20 connected in common to such pixel units 10.

The input and output terminals 13 are connected to the respective data lines 20, and are used, in a predetermined case, for reading an electric charge Q of the respective holding capacitors Cs included in the pixel units 10.

Furthermore, the array tester 200 shown in FIG. 2 is a first measuring device, and reads a corresponding-voltage that corresponds to the threshold voltage of the drive transistor T1, from the holding capacitor Cs of a pixel unit 10. Furthermore, the array tester 200 stores the corresponding-voltage read from the holding capacitor Cs, as a first correction parameter of the pixel unit 10, in a predetermined storage unit 43 used for the display panel 100. Specifically, the array tester 200 calculates the first correction parameter by measuring the threshold voltage Vth of the drive transistor T1 of the respective pixel units 10 on the circuit substrate. The array tester 200 includes a current measuring unit 221 and a communication unit 222. It should be noted that although the storage unit 43 is outside of the array tester 200 as shown in FIG. 2, a separate memory may be included inside the array tester 200 and transmission may be made from such memory to the storage unit 43.

The current measuring unit 221 measures a holding electric charge Qth of the respective holding capacitors Cs included in the pixel units 10 on the circuit substrate, by measuring the current of the pixel units 10 on the circuit substrate under a predetermined condition to be described later. Here, the holding capacitor Cs holds the holding electric charge Qth obtained by multiplying the corresponding-voltage that corresponds to the threshold voltage Vth of the drive transistor T1 by a capacitance C of the holding capacitor Cs, under a predetermined condition to be described later.

The communication unit 222 transmits, to the storage unit 43, the corresponding-voltage that corresponds to the threshold voltage Vth of the drive transistor T1 included in the pixel unit 10 and which is obtained by the calculation from the holding electric charge Qth measured by the current measuring unit 221.

The storage unit 43 is typically configured in a control circuit which is outside the array tester 200 and controls the display panel 100. The storage unit 43 stores the corresponding-voltage that corresponds to the threshold voltage Vth of the drive transistor T1 of the respective pixel units 10 on the circuit substrate, which is transmitted by the communication unit 222.

By using the circuit substrate and the array tester 200 configured in the above-describe manner, it is possible to measure the corresponding-voltage that corresponds to the threshold voltage Vth of the drive transistor T1 included in the respective pixel units 10 on the circuit substrate.

It should be noted that although the array tester 200 is used to measure the corresponding-voltage that corresponds to the threshold voltage Vth of the drive transistor T1 included in the respective pixel units 10 on the forward circuit substrate that is assembled as the display panel 100 in the aforementioned description, the present invention is not limited to such. The array tester 200 may be used to measure the corresponding-voltage that corresponds to the threshold voltage Vth of the drive transistor T1 included in the respective pixel units 10 in the display panel 100 including the organic EL elements D1.

Furthermore, although the high-voltage-side power line 24 and the standard-voltage power line 26 are different power lines in the above description, they may be a common power line when performing the measurement of the corresponding-voltage that corresponds to the threshold voltage Vth of the drive transistor T1, in the case where the organic EL element D1 is not provided in the respective pixel units 10, that is, in the case where the pixel unit 10 on the circuit substrate is measured.

Figure 4:
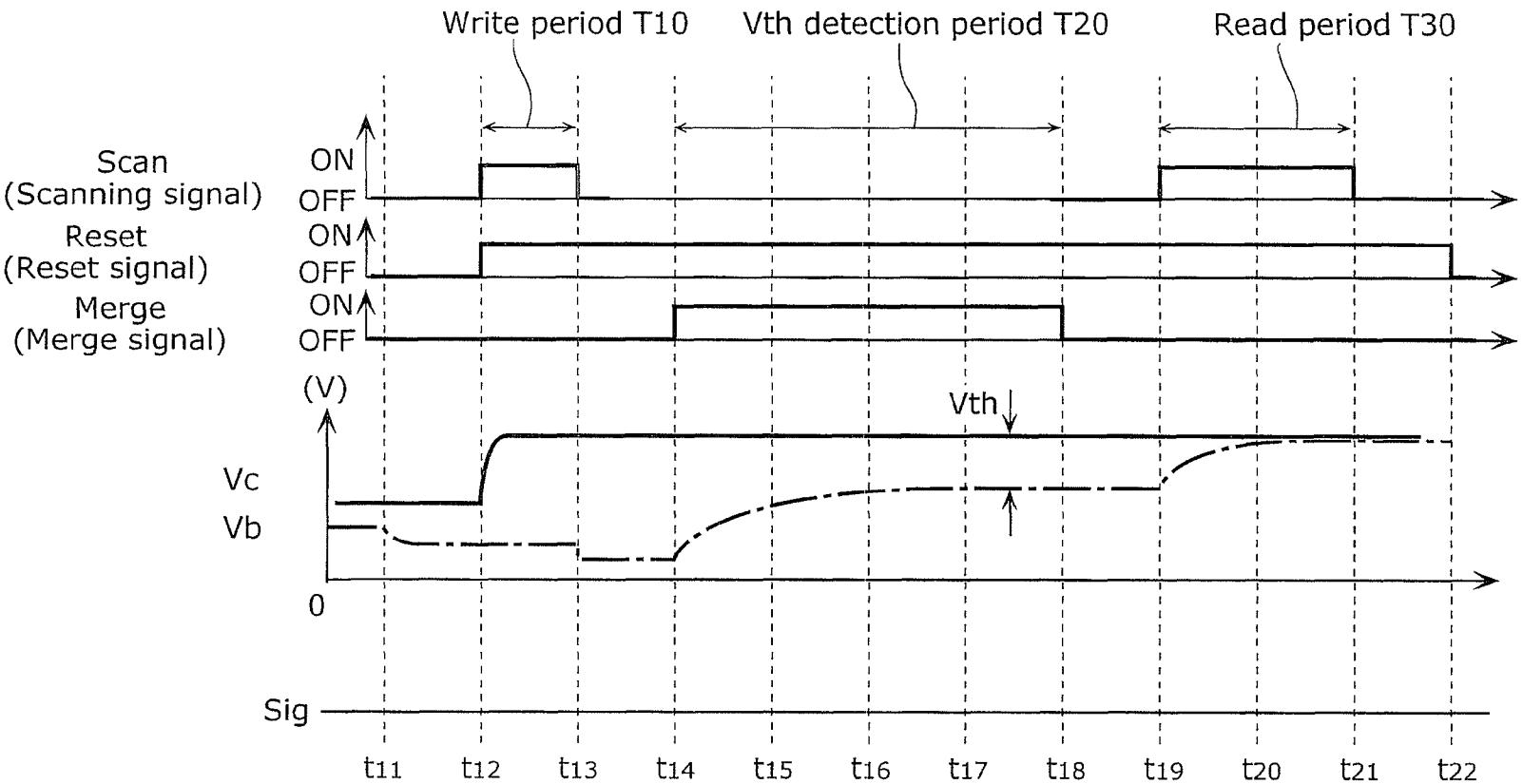
FIG. 4 is a timing chart showing operations of a pixel unit in an embodiment of the present invention.

Next, the measurement procedure when the corresponding-voltage that corresponds to the threshold voltage Vth of the drive transistor T1 included in a pixel unit 10 is measured using the array tester 200. FIG. 4 is a timing chart showing the operation of the pixel unit 10 in the embodiment of the present invention.

An operation for writing a signal voltage (data signal Data) corresponding to the image signal into the holding capacitor Cs, an operation for detecting the threshold voltage Vth of the drive transistor T1, and an operation for reading the electric charge held by the holding capacitor Cs are performed, within a certain measurement period, in each of the pixel units 10. Details of the operations shall be described hereafter with the period for writing the signal voltage (data signal Data) corresponding to the image signal into the holding capacitor Cs being a "write period T10", the period for detecting the threshold voltage Vth of the drive transistor T1 being a "Vth detection period T20", and the period for reading the electric charge held by the holding capacitor Cs being a "read period T30". It should be noted that the write period T10, the Vth detection period T20, and the read period T30 are defined for each of the pixel units 10, and the phases of the aforementioned three periods need not match for all the pixel units 10.

(Write period T10)

Figure 5:
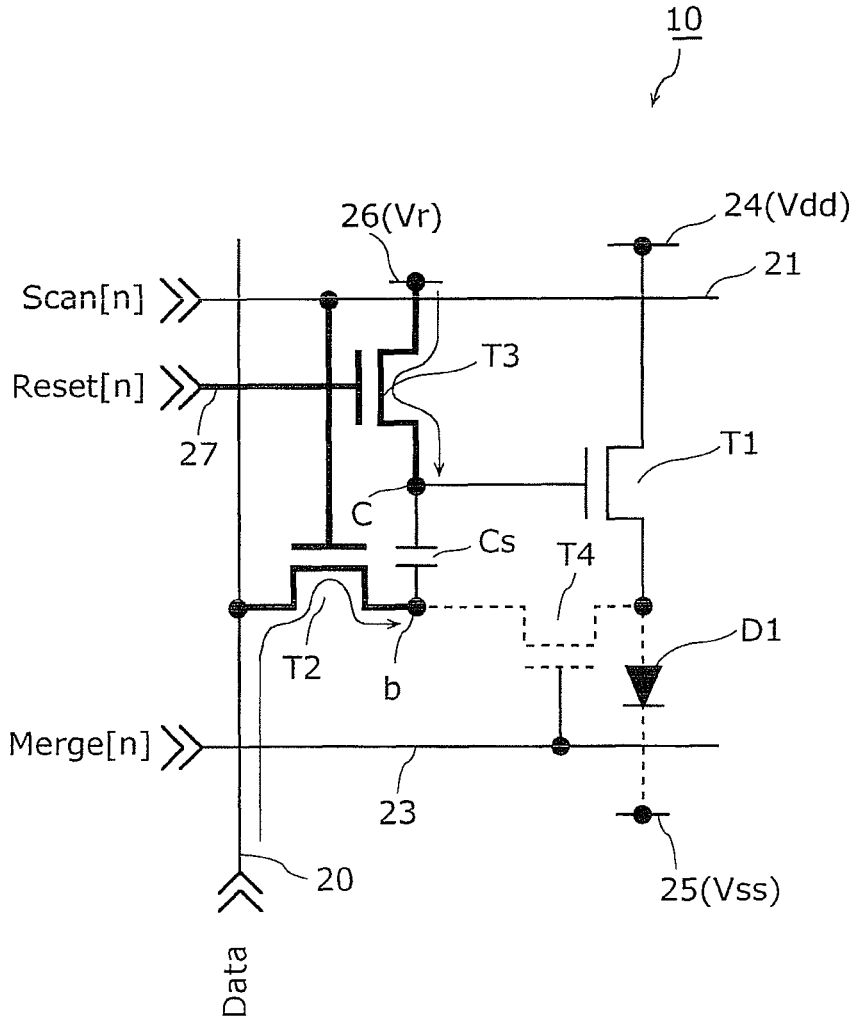
FIG. 5 is a diagram for describing operations in a write period T10 of a pixel unit in the embodiment of the present invention.

FIG. 5 is a diagram for describing operations in the write period T10 of a pixel unit in the embodiment of the present invention.

At a time t12 in the write period T10, first, the reset signal Reset that is supplied to the reset line 27 is set to the high level so as to place the reference transistor T3 into the ON state. Then, the standard voltage Vr supplied to the standard-voltage power line 26 is applied to a point c (the first electrode of the holding capacitor Cs). In other words, the standard-voltage Vr is written into the point c.

Here, in the standard-voltage power line 26, the standard-voltage Vr is set such that, in the case where the circuit substrate includes the organic EL elements D1, the organic EL elements D1 do not emit light. Specifically, the voltage value of a first standard-voltage is set so that, when the first standard-voltage is applied to the first electrode of the holding capacitor Cs, the potential difference between the first electrode and second electrode of the organic EL element D1 is a voltage that is lower than the threshold voltage of the organic EL element D1 at which the organic EL element D1 starts to emit light. In other words, the voltage value of a first standard-voltage is set so that, in the case where the corresponding-voltage that corresponds to the threshold voltage is to be measured in the holding capacitor Cs in the state where the organic EL element D1 is provided in each of the pixel units 10 of the circuit substrate, the organic EL element D1 does not emit light when the first standard-voltage is applied to the first electrode of the holding capacitor Cs.

Conversely, in the case where the circuit substrate does not include the organic EL elements D1, the voltage in the standard-voltage power line 26 is set to the same voltage Vdd as in the high-voltage-side power line 24. This can be realized, for example, by combining the high-voltage-side power line 24 and the standard-voltage power line 26 into a common power line. In other words, this can be realized by combining the high-voltage-side power line 24 and the standard-voltage power line 26 into a common power line when performing the measurement of the corresponding-voltage that corresponds to the threshold voltage of the drive transistor T1 in the case where the organic EL element D1 is not provided in the respective pixel units 10.

Next, the scanning signal Scan supplied to the scanning line 21 is set to the high level so as to turn ON the switching transistor T2. Then, a signal voltage (data signal Data) corresponding to the image signal supplied to the data line at this time is applied to a point b (second electrode of the holding capacitor Cs). Here, for example, this signal voltage (data signal Data) is set to the same voltage Vss as in the low-voltage-side power line 25. Furthermore, in the write period T10, the merge signal Merge supplied to the merge line 23 is at the low level and the isolation transistor T4 is in the OFF state.

As such, a voltage corresponding to the potential difference (Vr−Vss) between the point b and the point c is provided to the holding capacitor Cs, and the voltage is applied to the gate of the drive transistor T1. It should be noted that the voltage applied to the holding capacitor Cs assumes a magnitude that is equal to or greater than the threshold voltage Vth of the drive transistor T1.

Thus, the operation for writing into the holding capacitor Cs is performed in the manner described above. Specifically, while a first standard voltage Vr is applied to the first electrode of the holding capacitor Cs by turning ON the reference transistor T3, the switching transistor T2 is turned ON so that a second standard voltage which is lower than a value obtained by subtracting the threshold voltage of the drive transistor T1 from the first standard voltage Vr is applied to the holding capacitor Cs from the data line 20. As such, a write operation in which a potential difference that is larger than the threshold voltage of the drive transistor T1 is generated is performed in the holding capacitor Cs.

Subsequently, at a time t13 in which the write operation to the holding capacitor ends, that is, the write period T10 of the pixel unit 10 ends, the scanning signal Scan is returned to the low level so as to turn OFF the switching transistor T2.

(Vth Detection Period T20)

Figure 6:
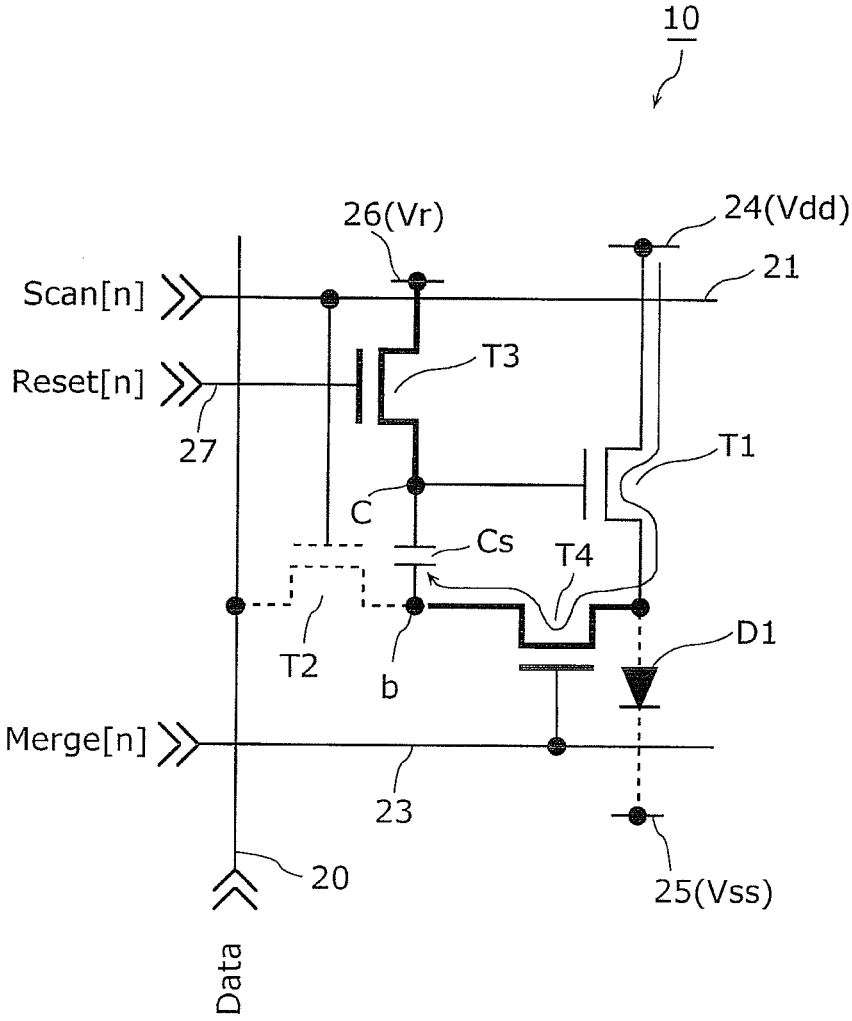
FIG. 6 is a diagram for describing operations in a Vth detection period T20 of the pixel unit in the embodiment of the present invention.

FIG. 6 is a diagram for describing operations in the Vth detection period T20 of a pixel unit in the embodiment of the present invention.

At an initial time t14 of the Vth detection period T20, a merge signal Merge supplied to the merge line 23 is set to a high level so as to turn ON the isolation transistor T4. Here, in the Vth detection period T20, the scanning signal Scan supplied to the scanning line 21 is at the low level, and the switching transistor T2 is in the OFF state. Furthermore, in the Vth detection period T20, a reset signal Reset supplied to the reset line 27 is at the low level, and thus the reference transistor T3 is in the ON state.

Then the standard voltage Vr supplied to the standard-voltage power line 26 (the potential at point c) is applied to the gate of the drive transistor T1, and thus the drive transistor T1 is in the ON state. At this time, the organic EL element D1 does not emit light, as described earlier. Specifically, the voltage value of the first standard-voltage is set so that, when the first standard-voltage is applied to the first electrode of the holding capacitor Cs, the potential difference between the first electrode and second electrode of the organic EL element D1 is a voltage that is lower than the threshold voltage of the organic EL element D1 at which the organic EL element D1 starts to emit light.

Subsequently, a part of the voltage Vdd of the high-voltage-side power line 24 which is in accordance with the standard voltage Vr applied to the gate of the drive transistor T1 is applied to the point b (the second electrode of the holding capacitor Cs) via the isolation transistor T4, and the potential of the point b (the second electrode of the holding capacitor Cs) rises.

Next, for example, by adjusting the processing time such as by waiting as is up to a time t18 as shown in FIG. 4, a voltage corresponding to the threshold voltage Vth of the drive transistor T1 (specifically, a voltage corresponding to a voltage that is lower than Vth) remains as the potential difference between the point b and point c, that is, the voltage held by the holding capacitor Cs. This is because the drive transistor T1 turns OFF at the point in time when a source-gate voltage Vgs and the threshold voltage Vth (specifically, a voltage lower than Vth) become equal. Specifically, by allowing the passage of time up to when the potential difference between the point b and point c, that is, the voltage between the first electrode and second electrode of the holding capacitor Cs reaches the threshold voltage of the drive transistor T1 and the drive transistor T1 turns OFF, the corresponding-voltage that corresponds to the threshold voltage of the drive transistor T1 is held in the holding capacitor Cs. Therefore, by adjusting the processing time, the holding capacitor Cs holds the electric charge Qth (electrical charge Qth=capacitance C×voltage) which is proportional to a corresponding-voltage that is lower than the threshold voltage Vth of the drive transistor T1.

Thus, in the holding capacitor Cs, a Vth compensation operation with which the held voltage becomes the corresponding-voltage that corresponds to the threshold voltage Vth is performed in the manner describe above.

Subsequently, at the time t18 in which the Vth compensation operation ends, that is, the pixel unit 10 Vth detection period T20 ends, the merge signal Merge is returned to the low level so as to turn OFF the isolation transistor T4.

Here, the reason why the voltage held by the holding capacitor Cs is a voltage corresponding to a voltage that is lower than Vth in the Vth compensation operation shall be described.

Figure 7:
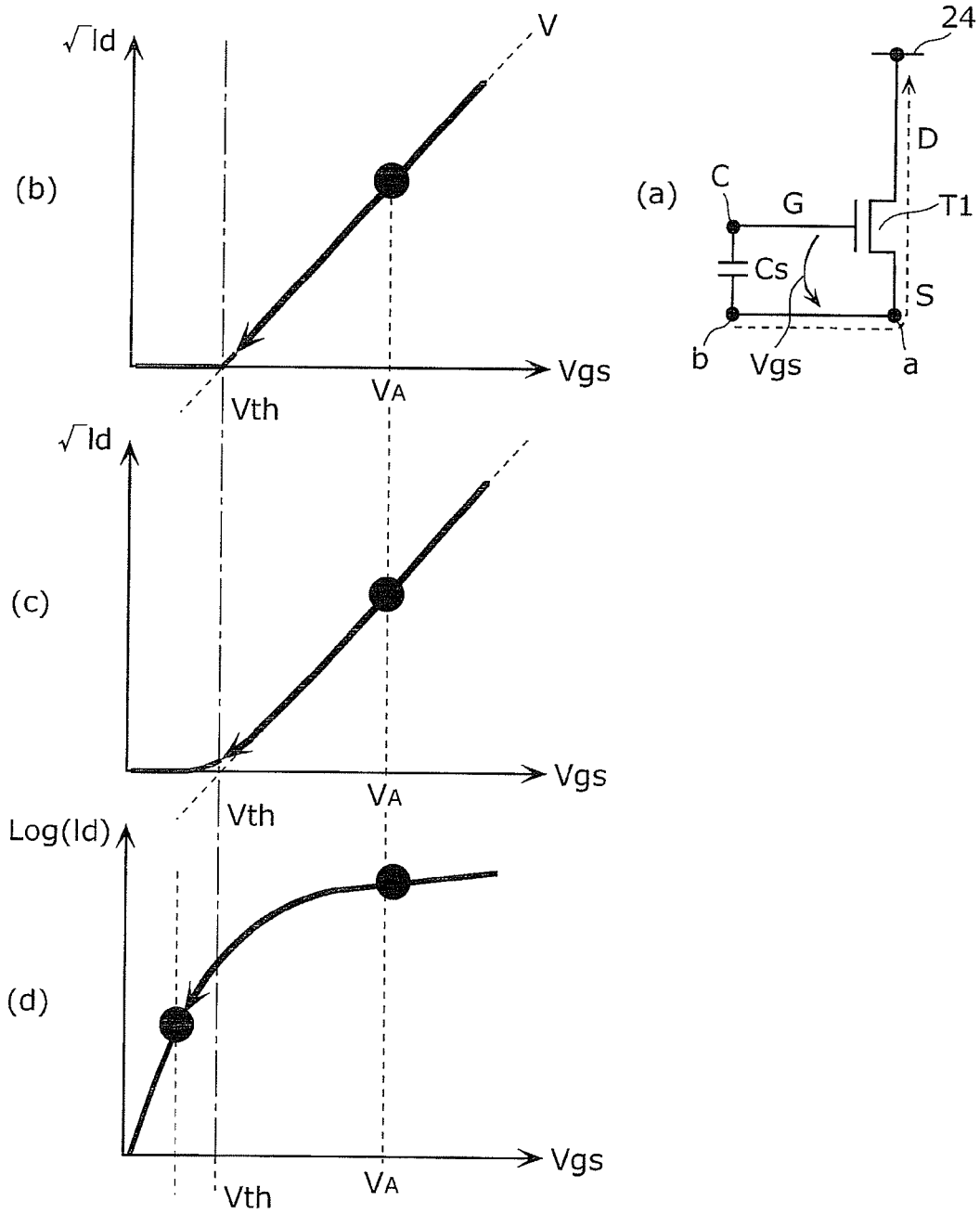
FIG. 7 is a diagram for describing the voltage held by a holding capacitor after Vth detection.

FIG. 7 is a diagram for describing the voltage held by the holding capacitor after Vth detection. Here, (a) in FIG. 7 is a graph selectively illustrating the drive transistor T1 and the holding capacitor Cs. In (a) in FIG. 7, illustration of the isolation transistor T4 is omitted since the isolation transistor T4 is turned ON during the Vth detection period. Since the voltage applied to the holding capacitor Cs is the gate-source voltage of the drive transistor T1, it shall be described as Vgs.

It is assumed that, for example, a voltage (VA) that is higher than the threshold voltage Vth of the drive transistor T1 is applied to the holding capacitor Cs shown in (a) in FIG. 7. Then, the holding capacitor Cs discharges the held electric charge to the Vdd-side through the TFT channel of the drive transistor T1. Then, since the current flowing in the TFT channel of the drive transistor T1 becomes smaller when the potential between the electrodes of the holding capacitor Cs becomes small, that is, when the voltage Vgs applied to the holding capacitor Cs becomes small, the discharging takes time.

Here, as shown in (b) in FIG. 7, in the ideal case where the current of the drive transistor T1 does not flow when the voltage applied to the drive transistor T1 is equal to or lower than the threshold voltage Vth, current no longer flows when the potential between the electrodes of the holding capacitor Cs becomes Vth. As such, the threshold voltage Vth of the drive transistor T1 is maintained in the holding capacitor Cs.

However, in actuality, there are variations in the TFT characteristics of the drive transistor T1. As such, as shown in (c) in FIG. 7, a minute current flows even when the voltage applied to the drive transistor T1 is equal to or lower than the threshold voltage Vth, and thus a voltage that is equal to or lower than the threshold voltage Vth of the drive transistor T1 is held in the holding capacitor Cs. In other words, as shown in (d) in FIG. 7, current flows in such a manner as to decrease exponentially when the voltage applied to the drive transistor T1 is equal to or lower than the threshold voltage Vth. As such, a potential that is equal to or lower than Vth is held in the holding capacitor Cs for a predetermined set time.

Therefore, in the Vth compensation operation, the voltage held by the holding capacitor Cs becomes a corresponding-voltage that corresponds to a voltage that is lower than Vth. In other words, the holding capacitor Cs holds a corresponding-voltage that corresponds to the threshold voltage. Here, as described above, the corresponding-voltage that corresponds to the threshold voltage is a voltage having a voltage value that is proportional to the voltage value of the threshold voltage Vth of the drive transistor T1 and is smaller than the voltage value of the threshold voltage Vth. Thus the corresponding-voltage referred to here includes these definitions.

(Read Period T30)

Figure 8:
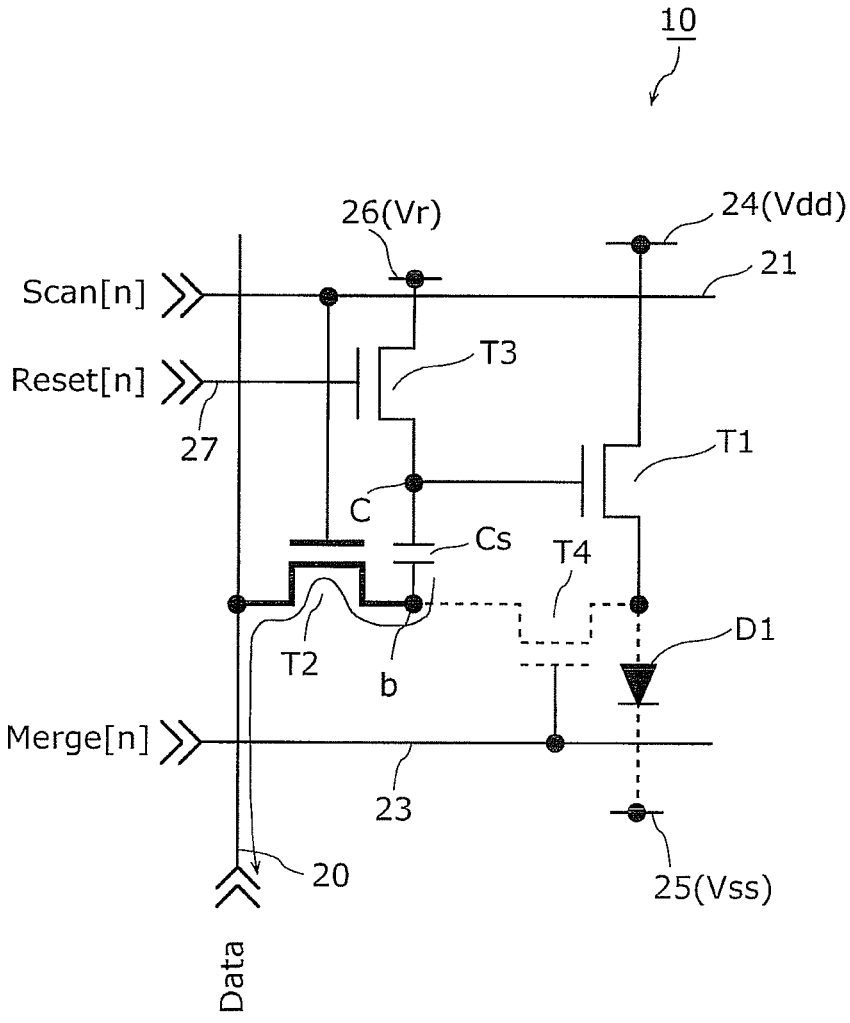
FIG. 8 is a diagram for describing operations in a read period T30 of a pixel unit in the embodiment of the present invention.

FIG. 8 is a diagram for describing operations in the read period T30 of a pixel unit in the embodiment of the present invention.

First, since the isolation transistor T4 is turned OFF after the Vth detection period T20, the holding capacitor Cs holds the electric charge Qth, that is, the electric charge Qth which is in accordance with the potential difference between the point b and point c.

Next, at an initial time t19 in the read period T30, the scanning signal Scan supplied to the scanning line 21 is set to the high level so as to turn ON the switching transistor T2.

Then, the second electrode (point b) of the holding capacitor Cs and the data line 20 are connected, and the electric charge Qth held by the holding capacitor Cs is read by the array tester 200 (current measuring unit 221) via the data line 20 and the input and output terminal 13 connected to the data line 20.

Specifically, the array tester 200 (current measuring unit 221) reads the electric charge Qth held by the holding capacitor Cs, by measuring the sum of the current via the input and output terminal 13.

This is because, for the capacitor, there is a relational expression of electrical charge amount Q=current i×time t.

Thus, the operation for reading the electric charge held by the holding capacitor Cs is performed in the manner described above. Specifically, after causing the holding capacitor Cs to hold the corresponding-voltage that corresponds to the threshold voltage Vth, the switching transistor T2 is turned ON, current corresponding to the corresponding-voltage flows from the second electrode of the holding capacitor Cs to the data line 20, and the current flowing in the data line 20 is measured by the array tester 200 (current measuring unit 221). With this, the operation for reading the corresponding-voltage held by the holding capacitor Cs is performed.

Subsequently, at time t21 at which the read period T30 ends, the scanning signal Scan is returned to the low level so as to turn OFF the switching transistor T2.

It should be noted that the array tester 200 (current measuring unit 221) reads, in parallel from each of the data lines 20, the electric charges Qth held by the holding capacitors Cs included in the respective pixel units 10.

Thus, in this manner, the array tester 200 reads the electric charge Qth held by the holding capacitor Cs included in the pixel unit 10.

In addition, in the array tester 200, the threshold voltage Vth (including the corresponding-voltage equal to or lower than the Vth) of the drive transistor T1 included in the pixel unit 10 is calculated from the holding electric charge Qth read by the current measuring unit 221, and this is transmitted to the storage unit 43 by the communication unit 222 and stored as the first correction parameter.

Here, the threshold voltage Vth is calculated according to the relational expression of the capacitor expressed as: electrical charge amount Q=capacitance C×voltage V. Specifically, the threshold voltage Vth (including the corresponding-voltage equal to or lower than the Vth) of the drive transistor T1 which is held by the holding capacitor Cs can be calculated by dividing the electric charge Qth held by the holding capacitor Cs by the capacitance of the holding capacitor Cs.

In this manner, the array tester 200 can measure the threshold voltage Vth (including the corresponding-voltage equal to or lower than the Vth) of the drive transistor T1 included in the respective pixel units 10. In addition, the array tester 200 can store the measured threshold voltage Vth (including the corresponding-voltage equal to or lower than the Vth) of the drive transistor T1 into the storage unit 43, as the first correction parameter.

Figure 9:
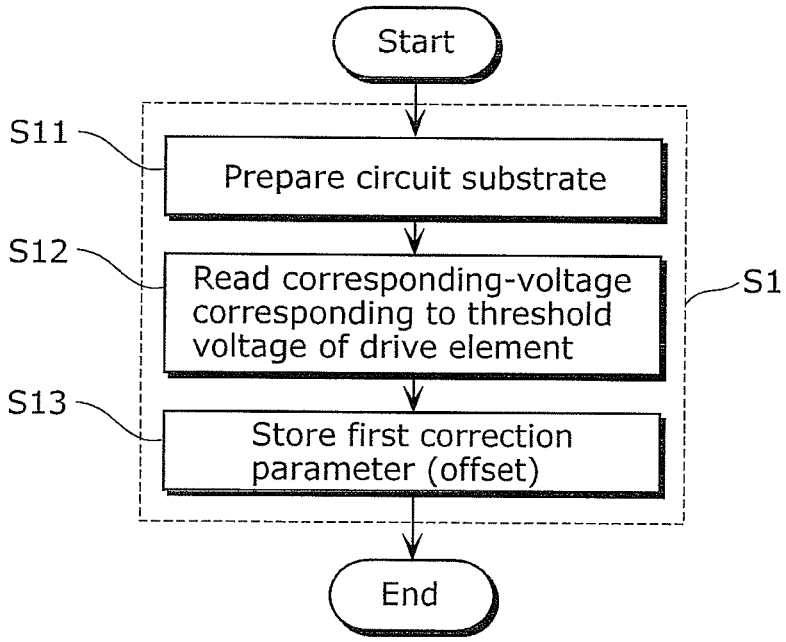
FIG. 9 is a flowchart for describing a first correction parameter calculation process.

The above-described measurement procedure, that is, the flow of the first correction parameter calculation process shall be described using the Drawings. FIG. 9 is a flowchart for describing the first correction parameter calculation process.

First, the circuit substrate provided with the pixel units 10 each of which includes the voltage-driven drive transistor T1 and the holding capacitor Cs having the first electrode connected to the gate electrode of the drive transistor T1 and the second electrode connected to the source electrode of the drive transistor T1 is prepared (S11).

Next, the holding capacitor Cs included in the pixel unit 10 is caused to hold the corresponding-voltage that corresponds to the threshold voltage of the drive transistor T1, and the corresponding-voltage held by the holding capacitor Cs is read from the pixel unit 10 using the array tester 200 (S12). It should be noted that although the array tester 200 reads the electric charge Qth held in the holding capacitor Cs, and calculates the threshold voltage Vth from the read electric charge Qth, this is expressed as: the corresponding-voltage held by the holding capacitor Cs is read from the pixel unit 10 using the array tester 200.

Next, the array tester 200 stores the read corresponding-voltage, as a first correction parameter of the pixel unit 10, in the predetermined storage unit 43 used for the display panel 100 (S13).

Thus, the first correction parameter calculation process (S1) is performed, and the first correction parameter is stored in the storage unit 43 in the manner described above.

It should be noted that the above-described first correction parameter calculation process is performed for each of the pixel units 10. Then, the array tester 200 stores the first correction parameters in the storage unit 43, in association with the respective pixel units 10.

Subsequently, the first correction parameter stored in the storage unit 43 is used as an offset for correcting, to the predetermined standard luminance, the luminance of the organic EL element D1 corresponding to the image signal supplied to the respective pixel units 10. With this, it is possible to reduce the number of times measurement is performed in the luminance measurement for the respective pixels for calculating gain as a second correction parameter for correcting, to the predetermined standard luminance, the luminance of the organic EL element D1 corresponding to the image signal supplied to the respective pixel units 10.

Furthermore, as described above, the voltage that corresponds to the threshold voltage of the drive transistor T1 is a voltage having a voltage value that is proportional to the voltage value of the threshold voltage and is smaller than the voltage value of the threshold voltage. In this manner, when the value of the voltage to be read is not the value of the threshold value of the drive transistor T1 but a voltage value that is smaller than the voltage value of the drive transistor T1, the low gradation region of representative voltage-luminance characteristics corresponds to a voltage region that is smaller than the threshold voltage. In addition, reading the voltage having a value smaller than the threshold value of the drive transistor T1 and using this as the first correction parameter (offset) produces the advantageous effect of enhancing the correction precision in the high gradation region of the representative voltage-luminance characteristics.

Hereinafter, a method of calculating gain which is the second correction parameter, using the first correction parameter (offset) shall be described.

Figure 10:
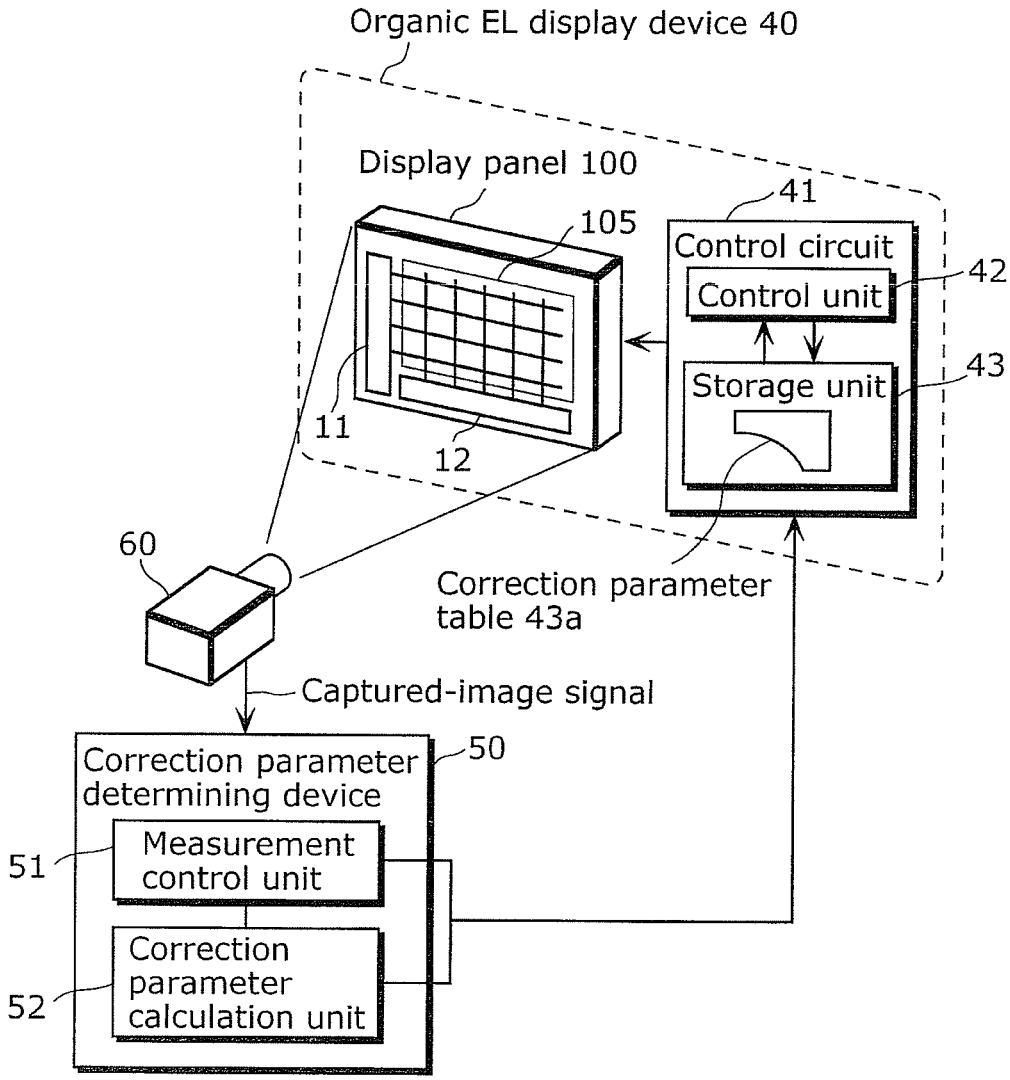
FIG. 10 is a diagram showing a configuration of a luminance measurement system at the time of luminance measurement of the display panel.

FIG. 10 is a diagram showing a configuration of a luminance measurement system at the time of luminance measurement for the display panel.

Luminance measurement for the display panel 100 is performed on the prepared display panel 100 (the display panel 100 included in an organic EL display device 40), by using a measuring device 60. In addition, in the present system configuration, the luminance unevenness in the display panel 100 can be reduced while shortening the luminance measurement time, as described later.

The luminance measurement system shown in FIG. 10 includes the organic EL display device 40, a correction parameter determining device 50, and the measuring device 60, and is intended to perform luminance measurement on the display panel 100 of the organic EL display device 40 and obtain gain which is the second correction parameter.

The organic EL display device 40 includes a control unit 41 and the display panel 100.

As described earlier, the display panel 100 includes the display unit 105, the scanning line drive circuit 11, and the data line drive circuit 12, and displays images on the display unit 105 based on signals inputted to the scanning line drive circuit 11 and the data line drive circuit 12 from the control unit 41.

The control circuit 41 includes a control unit 42 and the storage unit 43, and has a function of supplying image signals for displaying on the display panel 100, and causing the display panel 100 to display images, by controlling the scanning line drive circuit 11 and the data line drive circuit 12. Specifically, the control circuit 41 causes the pixel units 10 included in the display panel 100 to emit light, according to an instruction from a measurement control unit 51. Furthermore, the control circuit 41 further writes, into the storage unit 43, the second correction parameter (gain) for each of the pixel units 10 calculated by a correction parameter calculation unit 52.

Figure 12:
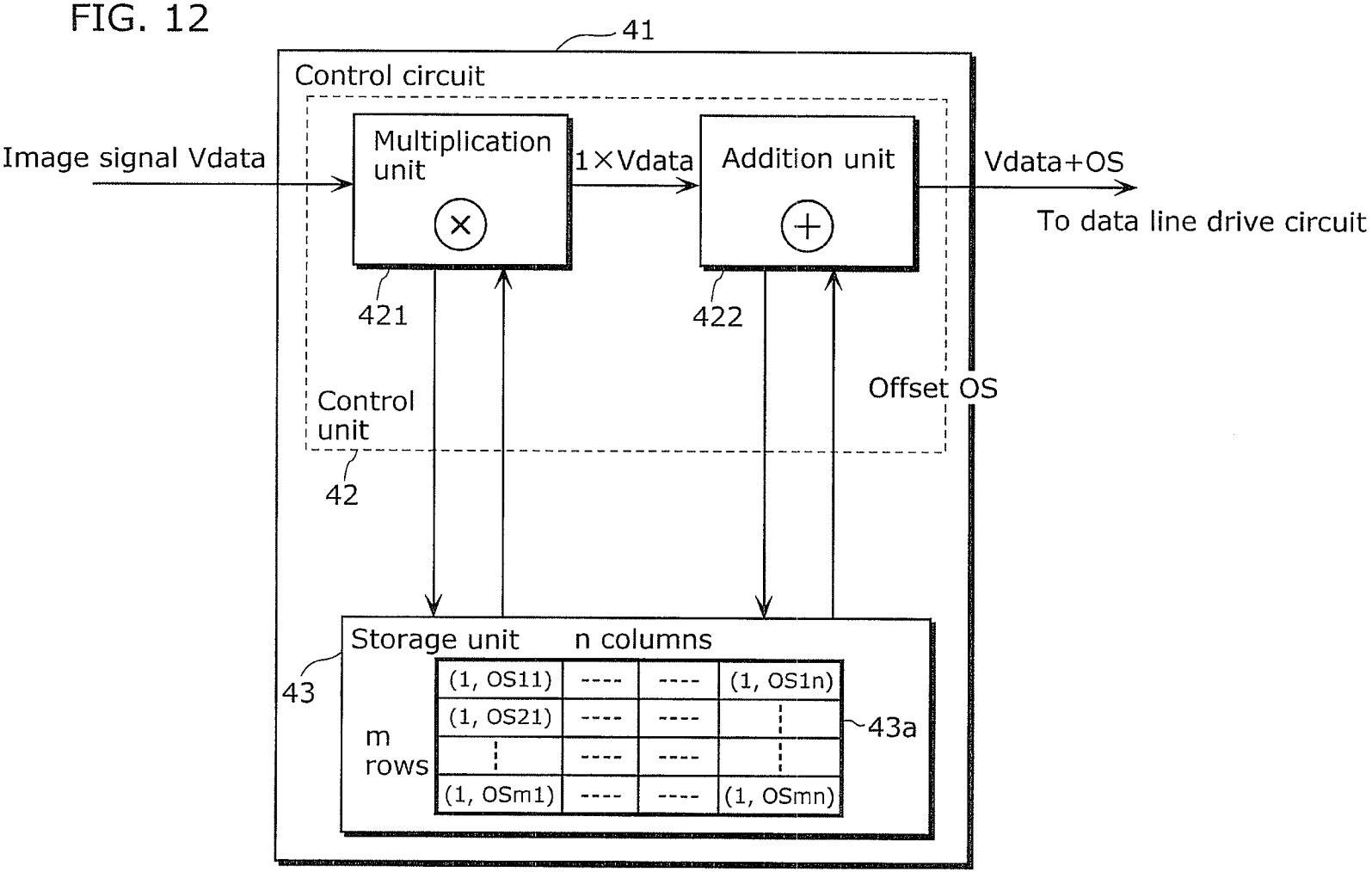
FIG. 12 is a diagram showing an example of a function configuration diagram for a control circuit in the present embodiment.

FIG. 11 is a table showing an example of a correction parameter table held by the storage unit in the present embodiment. FIG. 12 is a diagram showing an example of a function configuration diagram for the control circuit in the present embodiment.

The storage unit 43 stores, for each of the pixel units 10, the correction parameters for correcting the image signals inputted from an external source, in accordance with the characteristics of the respective pixel units 10. Specifically, the storage unit 43 stores a correction parameter table 43*a* including the first correction parameter and the second correction parameter for each of the pixel units 10.

As shown in FIG. 11, the correction parameter table 43*a* is a data table which includes the correction parameter made up of the first parameter (offset) and the second parameter (gain) for each of the pixel units 10. In FIG. 11, the first correction parameters are denoted as offset OS11 to offset OSmn. The second parameters are denoted as gain G11 to gain Gmn, that is, the correction parameter table 43 stores correction parameters made up of the gains and offsets (denoted as (G, OS) in the table) for the respective pixel units 10 in conformity with the (m row×n column) matrix of the display unit 105.

Here, that is, at the time of the luminance measurement of the display panel 100, the above-described first parameter calculation process (S1) has already been performed and the first correction parameters (offset) are stored in the storage unit 43. In such state, the second correction parameter is calculated by performing the luminance measurement of the display panel. As such, as shown in FIG. 12, gain, which is the second parameter, is stored in the correction parameter table 43 as "1", that is, (1, OS11) to (1, OSmn) for the sake of convenience.

The control unit 42 includes a multiplication unit 421 and an addition unit 422. The control unit 42 reads a correction parameter corresponding to each of the pixel units 10 from the storage unit 43, and obtains a corrected signal voltage by performing the calculation on the image signal corresponding to the respective pixel units 10 using the read correction parameter. In addition, the control unit 42 causes the display panel 100 to display an image by outputting the corrected signal voltage obtained by calculation to the display panel 100.

Specifically, at the time of luminance measurement on the display panel 100, the gains, which are the correction parameters corresponding to the respective pixel units 10 and which are the second correction parameters, that are denoted as "1" in (1, OS11) to (1, OSmn) for the sake of convenience are read from the correction parameter table 43*a* of the storage unit 43. Then, in accordance with the read second correction parameter (gain), the signal voltage (Vdata) corresponding to the respective pixel units 10 is multiplied by 1 (a gain value). The corrected signal voltage is obtained by adding the already stored OS (offset value) corresponding to the respective pixel units 10 to the signal voltage 1×Vdata after multiplication.

The measuring device 60 is a measuring device which can measure luminance that is emitted by the pixel units 10 included in the display panel 100. Specifically, the measuring device 60 is an image sensor such as a charge coupled device (CCD) image sensor, and can precisely measure the luminance of all the pixel units 10 included in the display unit 105 of the display panel 100 in one image-capturing operation. It should be noted that the measurement unit 60 is not limited to an image sensor and may be any type of measuring device as long as it is capable of measuring the luminance of the pixel units 10 of the display unit 105.

The correction parameter determining device 50 includes the measurement control unit 51 and the correction parameter calculation unit 52. The correction parameter determining device 50 is a device which determines the second correction parameter (gain) for correcting, to the standard luminance, the luminance of the pixel units 10 included in the display unit 105 of the display panel 100, based on the luminance of the respective pixel units 10 measured by the measuring device 60. Furthermore, the correction parameter determining device 50 outputs the determined second correction parameter (gain) to the control circuit 61 of the organic EL display device 40. Here, the standard luminance is a luminance obtained when a predetermined voltage is inputted to the function of the representative voltage-luminance characteristics.

The measurement control unit 51 is a processing unit which measures the luminance emitted by the pixel units 10 included in the display panel 100.

Specifically, the measurement control unit 51 first obtains the function of the representative voltage-luminance characteristics that is common among the pixel units 10 included in the display panel 100. Here, the representative voltage-luminance characteristics are voltage-luminance characteristics that serve as a standard for making luminance uniform. For example, the representative voltage-luminance characteristics are the voltage-luminance characteristics of one pixel unit 10 in a predetermined position among the pixel units 10 included in the display panel 100. Furthermore, for example, the representative voltage-luminance characteristics are voltage-luminance characteristics obtained by averaging the voltage-luminance characteristics of two or more pixel units 10 among the pixel units 10 included in the display panel 100. It should be noted that, in this case, since the correction parameter is calculated so that the luminance of each of the pixel units 10 included in the display panel 100 assumes the representative voltage-luminance characteristics common throughout the entire display panel 100, using such correction parameters to correct the image signals produces the effect of being able to even out the luminance of the lights emitted by the respective pixel units 10. Furthermore, the function of the representative voltage-luminance characteristics is a function of the relationship between the signal voltage supplied to the drive transistor T1 and the luminance emitted by the pixel unit 10 by way of the organic EL element D1. It should be noted that the function of the representative voltage-luminance characteristics is assumed to be determined in advance through a separate measurement and the like.

Furthermore, the measurement control unit 51 obtains the luminance by causing the control circuit 41 to cause the pixel units 10 included in the display panel 100 to emit light, and causing the measuring device 60 to measure the luminance emitted by the pixel units 10.

Specifically, the measurement control unit 51 obtains the luminance by applying, to the drive transistor T1 which is the drive element included in the respective pixel units 10, a signal voltage obtained by adding the first correction parameter of the pixel unit 10 to the signal voltage corresponding to one gradation level belonging to either an intermediate gradation region or a high gradation region of the representative voltage-luminance characteristics, and by measuring the luminance emitted by the pixel units 10, using the measuring device 60.

Figure 13:
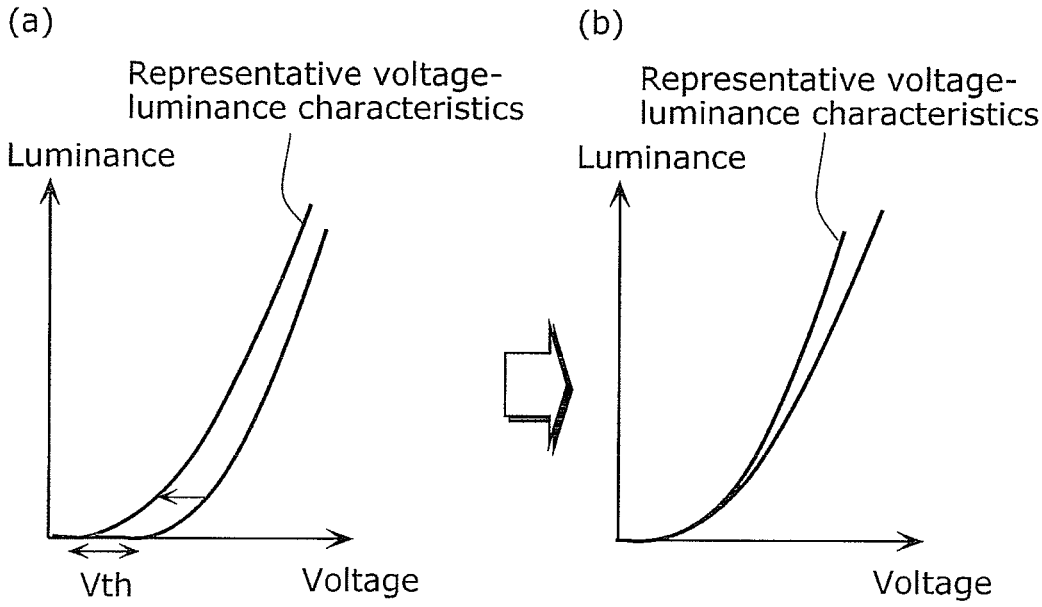
FIG. 13 shows voltage-luminance characteristics of a predetermined pixel unit and representative voltage-luminance characteristics.

Here, the reason why the measurement control unit 51 measures a signal voltage corresponding to one gradation level belonging to either the intermediate gradation region or the high gradation region of the representative voltage-luminance characteristics shall be described. FIG. 13 shows the voltage-luminance characteristics of a predetermined pixel unit and the representative voltage-luminance characteristics. (a) in FIG. 13 shows the voltage-luminance characteristics of a predetermined pixel unit 10, and (b) in FIG. 13 shows voltage-luminance characteristics in the case where the corresponding-voltage that corresponds to the threshold voltage Vth of the drive transistor T1 calculated through the above-described first correction parameter calculation process (S1) is added as the first correction parameter (offset), in the predetermined pixel unit 10.

As shown in (b) in FIG. 13, when the first correction parameter (offset) is added, the voltage-luminance characteristics of the predetermined pixel unit 10 and the representative voltage-luminance characteristics show close characteristics in the low gradation region of the representative voltage-luminance characteristics. In other words, by displaying luminance according to a voltage to which the first correction parameter (offset) has been added, the voltage-luminance characteristics of the pixel units 10 show a matching state with the representative voltage-luminance characteristics in the low gradation region. On the other hand, in the high gradation region of the representative voltage-luminance characteristics, the voltage-luminance characteristics of the predetermined pixel unit 10 and the representative voltage-luminance characteristics do not show close characteristics. In other words, with the high gradation region of the representative voltage-luminance characteristics, there is a gap between both characteristics, and both show an unmatched state.

Therefore, since close characteristics are shown even when a signal voltage corresponding to one gradation level belonging to the low gradation region among the regions of the representative voltage-luminance characteristics is measured, the effect is minimal. However, it is more effective when the measurement control unit 51 measures a signal voltage corresponding to one gradation level belonging to either the intermediate gradation region or the high gradation region among the regions of the representative voltage-luminance characteristics, and calculates the gain. Specifically, merely calculating the gain in the high gradation region of the representative voltage-luminance characteristics is effective because, aside from the low gradation region, it is also possible to bring the characteristics close even in the high gradation region.

The correction parameter calculation unit 52 calculates the second correction parameter (gain) for the pixel, using the luminance obtained by the measurement control unit 51 and the function of the representative voltage-luminance characteristics. The correction parameter calculation unit 52 outputs the calculated second correction parameter (gain) to the control circuit 41. Subsequently, the control circuit 51 stores the second correction parameter (gain) in the storage unit 43.

Specifically, the correction parameter calculation unit 52 (i) obtains, by calculation, the voltage such that the luminance obtained by the measurement control unit 51, that is, the luminance when the pixel unit 10 is caused to emit light according to a predetermined signal voltage is the luminance obtained when the predetermined signal voltage is inputted to the function of the representative voltage-luminance characteristics, and calculates the second correction parameter (gain) indicating the ratio between such predetermined signal voltage and the voltage obtained by calculation. In other words, the second correction parameter (gain) is the ratio of the predetermined signal voltage to the voltage obtained in the case where the luminance when the pixel unit 10 is caused to emit light according to the predetermined signal voltage is inputted to the function of the representative voltage-luminance characteristics.

It should be noted that the second correction parameter (gain) may be calculated as the ratio of the luminance when the pixel unit 10 is caused to emit light according to the predetermined signal voltage and the luminance (standard luminance) obtained when the predetermined signal voltage is inputted.

Furthermore, the correction parameter calculation unit 52 obtains the second correction parameter for the respective colors, namely, the red color, green color, and blue color emitted by the organic EL element D1.

Here, the representative voltage-luminance characteristics, the high gradation region, and the low gradation region shall be described.

Figure 14:
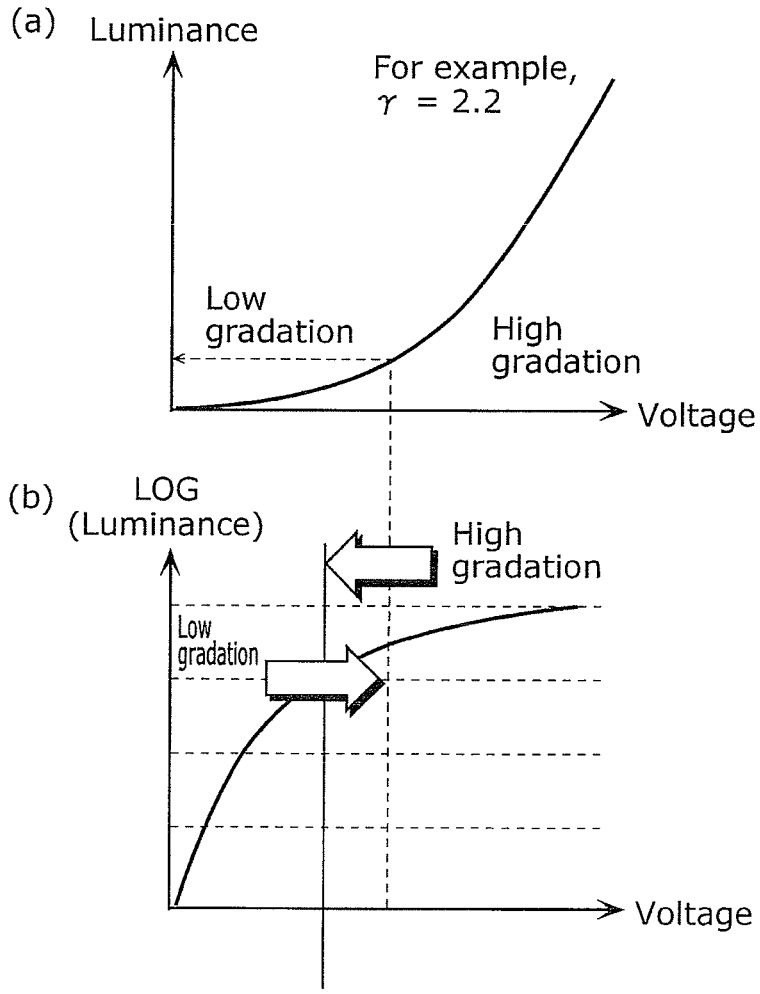
FIG. 14 is a diagram for describing the representative voltage-luminance characteristics, the high gradation region, and the low gradation region in the present embodiment.

FIG. 14 is a diagram for describing the representative voltage-luminance characteristics, the high gradation region, and the low gradation region in the present embodiment.

As shown in (a) in FIG. 14, the representative voltage-luminance characteristics show the characteristics represented by a curve in which the luminance emitted by the pixel unit 10 is proportional to the γ (gamma) power (for example, γ=2.2) of the voltage supplied to the drive transistor T1.

In addition, the pixel units 10 included in the display panel 100 have respectively different voltage-luminance characteristics. As such, in the present embodiment, the representative voltage-luminance characteristics are assumed to be the voltage-luminance characteristics of a single arbitrary pixel among the pixel units 10 included in the display panel 100. With this, the function of the representative voltage-luminance characteristics can be obtained easily.

It should be noted that the representative voltage-luminance characteristics are the characteristics set in common throughout the entirety of the display panel 100 including the pixel units 10, and may be the characteristics obtained by averaging the voltage-luminance characteristics of the respective pixel units 10 included in the display panel 100. In this case, since the correction parameter is calculated so that the luminance of each of the pixel units 10 included in the display panel 100 assumes the representative voltage-luminance characteristics common throughout the entire display panel 100, using such correction parameters to correct the image signals allows the luminance of the lights emitted by the respective pixel units 10 to be evened-out.

Furthermore, (b) in FIG. 14 shows the representative voltage-luminance characteristics that is in accordance with human visual sensitivity. Specifically, since the human eye has a sensitivity that is close to a LOG function, representative voltage-luminance characteristics that are in accordance with human visual sensitivity show characteristics in which luminance is represented by the curve of the LOG function.

As such, since the human eye does not easily recognize luminance unevenness in the high gradation regions and easily recognizes luminance unevenness in the low gradation regions, in order to adjust to human visual sensitivity, it is preferable to set the width of the high gradation region wide and the width of the low gradation region narrow.

Therefore, the signal voltage corresponding to one gradation level belonging to the high gradation region of the representative voltage-luminance characteristics is preferably a voltage corresponding to a gradation level that is 20% to 100% of the maximum gradation level that can be displayed by each of the pixel units 10, and is more preferably a voltage corresponding to a gradation level that is 30% of the maximum gradation level. This is because, this allows for maximum suppression of correction error in the high gradation region.

Furthermore, the signal voltage corresponding to one gradation level belonging to the intermediate gradation region of the representative voltage-luminance characteristics is preferably a voltage corresponding to a gradation level that is 10% to 20% of the maximum gradation level that can be displayed by each of the pixel units 10.

It should be noted that the one gradation level belonging to the low gradation region of the representative voltage-luminance characteristics is preferably a gradation level that is 0% to 10% of the maximum gradation level that can be displayed by each of the pixel units 10. Furthermore, since a gradation level that is below 0.2% of the maximum gradation level emitted by each of the pixel units 10 cannot be visually recognized by the human eye, it is further preferable that the one gradation level belonging to the low gradation region of the representative voltage-luminance characteristics be a gradation level that is 0.2% to 10% of the maximum gradation level.

Figure 15:
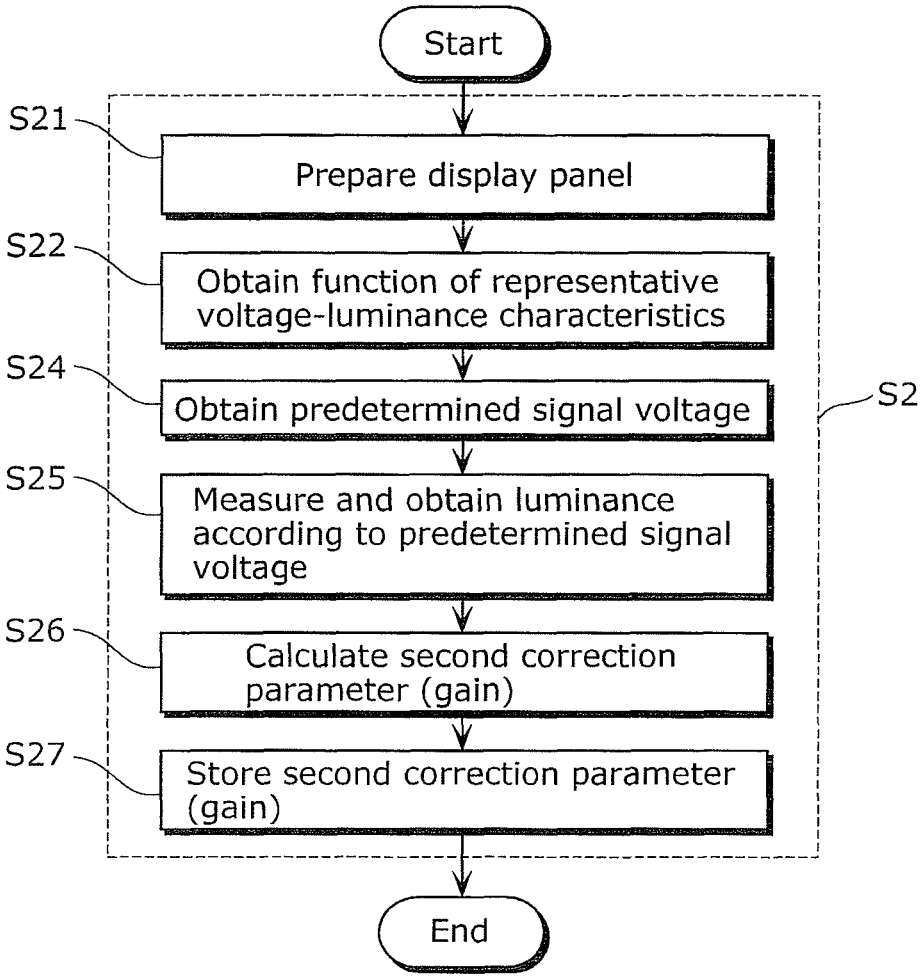
FIG. 15 is a flowchart showing an example of operations for calculating a second correction parameter in the luminance measurement system in the present embodiment.
Figure 16:
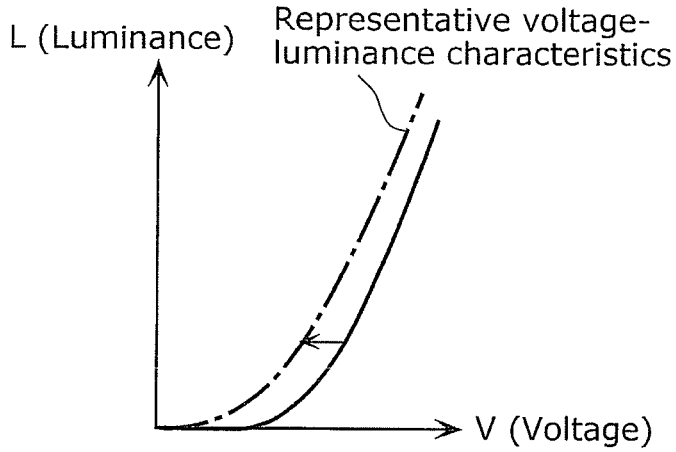
FIG. 16 is a graph for conceptually describing S24.
Figure 17:
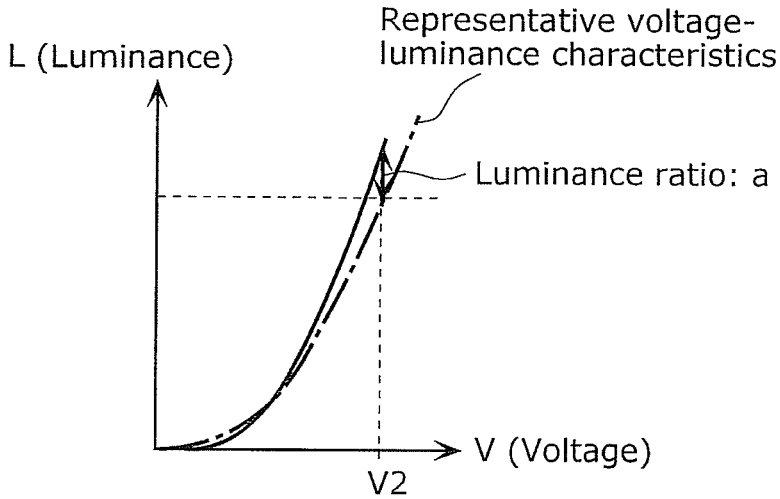
FIG. 17 is a graph for conceptually describing S26.

Next, the flow of the second correction parameter calculation process (measurement procedure) shall be described with reference to the Drawings. FIG. 15 is a flowchart showing an example of operations for calculating the second correction parameter in the luminance measurement system in the present embodiment. FIG. 16 is a graph for conceptually describing S24, and FIG. 17 is a graph for conceptually describing S26.

First, the display panel 100 (organic EL display device 40), which includes the above-described circuit substrate, and includes the organic EL elements D1 which emits light according to the drive current of the drive transistors T1 of the respective pixel unit 10 included in the circuit substrate, is prepared (S21)

Next, the measurement control unit 51 obtains the function of the representative voltage-luminance characteristics common among the pixel units 10 included in the display panel 100 (S22).

Next, the measurement control unit 51 causes the control circuit 41 to apply, to the pixel units 10 included in the display panel 100, the signal voltage corresponding to one gradation level of either the intermediate gradation region or the high gradation region of the representative voltage-luminance characteristics. In the control circuit 41, the control unit 42 obtains the predetermined signal voltage by obtaining the first correction parameter (offset) for the pixel unit 10 from the storage unit 43 and adds this first correction parameter to the signal voltage (S24). It should be noted that this is because, when displaying luminance of the pixel unit 10 according to the predetermined signal voltage obtained through the addition of the first correction parameter (offset), the voltage-luminance characteristics thereof can be displayed in a matched state with the representative voltage-luminance characteristics in the low gradation region, as shown in FIG. 16.

Subsequently, the control circuit 41 applies the predetermined signal voltage to the drive transistor T1 included in the pixel unit 10.

Next, the measurement control unit 51 measures and obtains the luminance emitted by the pixel unit 10 included in the display panel 100, using the measuring device 60 (S25). Specifically, the measurement control unit 51 obtains the luminance by causing the control circuit 41 to apply, to the drive transistors T1 included in the respective pixel units 10, the predetermined signal voltage obtained through the addition of the first correction parameter (offset), and by causing the measuring device 60 to measure the luminance emitted by the pixel units 10.

Next, the correction parameter calculation unit 52 calculates the second correction parameter (gain) using the luminance obtained by the measurement control unit 51 and the function of the representative voltage-luminance characteristics (S26). Specifically, the correction parameter calculation unit 52 calculates the second correction parameter with which the luminance of the pixel 10 measured and obtained in S25 becomes the luminance obtained when the predetermined signal voltage is inputted to the representative voltage-luminance characteristics. Here, as shown in FIG. 17 for example, the voltage-luminance characteristics of the pixel units 10 match with the representative voltage-luminance characteristics in the low gradation region but do not match in the intermediate gradation region and the high gradation region. As such, the correction parameter calculation unit 52 calculates the second correction parameter (gain) from the luminance ratio which is the ratio between the luminance of the pixel unit 10 and the luminance according to the representative voltage-luminance characteristics, according to the signal voltage (V2 in the figure) corresponding to one gradation level belonging to either of the intermediate gradation region or the high gradation region of the representative voltage-luminance characteristics. It should be noted that the details of the process in which the correction parameter calculation unit 52 calculates the second correction parameter shall be describe later.

Subsequently, the correction parameter calculation unit 52 stores the calculated second correction parameter (gain) in the storage unit 43, in association with the pixel unit 10 (S27). Specifically, the correction parameter calculation unit 52 transmits the calculated second correction parameter (gain) to the control circuit 41, in association with the pixel unit 10, and the control circuit 41 stores the received second correction parameter in the storage unit 43.

In this manner, the second correction parameter calculation process (S2) for calculating the second correction parameter is performed in the luminance measurement system.

It should be noted that the above-described process is performed for the respective colors, namely, the red color, green color, and blue color emitted by the organic EL element D1. In other words, the measurement control unit 51 measures and obtains the luminance of the pixel units 10 according to the predetermined voltage, for the respective colors, namely, the red color, the green color, and the blue color. Then, the correction parameter calculation unit 52 obtains the second correction parameter for the respective colors, namely, the red color, green color, and blue color. Then, the correction parameter calculation unit 52 outputs, to the control circuit 41, the second correction parameter for the respective colors, namely, the red color, green color, and blue color, and causes the control circuit 41 to write the second correction parameter into the storage unit 43. With this, it is possible to perform correction for the respective colors, namely, the red color, green color, and blue color, so that luminance is evened-out.

Furthermore, in the organic EL display device 40 in which the correction parameters (gain) are written in the storage unit 43, the control circuit 41 reads, from the storage unit 43, the respective correction parameters (gain) corresponding to the pixel units 10 for the image signal inputted from the external source, and corrects the image signals corresponding to the respective pixel units 10. Subsequently, the control circuit 41 causes the display panel 100 to display images, by controlling the scanning line drive circuit 11 and the data line drive circuit 12 based on the corrected image signals.

Figure 18:
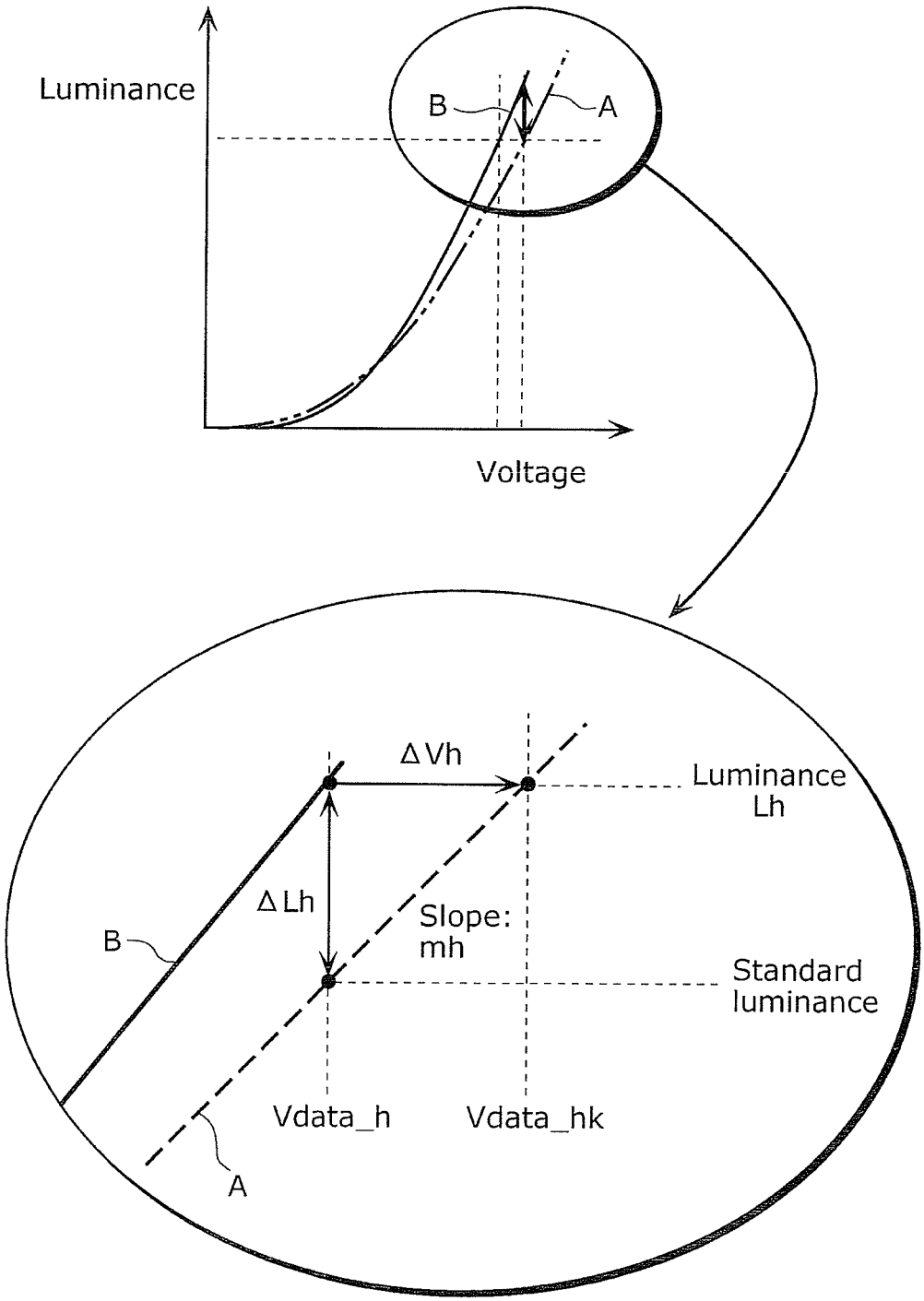
FIG. 18 is a diagram for describing a process by which a correction parameter calculation unit 52 calculates the second correction parameter in the present embodiment.

FIG. 18 is a diagram for describing the process by which the correction parameter calculation unit calculates the second correction parameter in the present embodiment. It should be noted that a curve A shown in FIG. 18 shows the representative voltage-luminance characteristics, and a curve B shows the voltage-luminance characteristics the pixel unit 10.

The correction parameter calculation unit 52 calculates, for the pixel unit 10, the second correction parameter with which the luminance when the pixel unit 10 is caused to emit light according to the predetermined signal voltage becomes a luminance (standard luminance) when the predetermined signal voltage is inputted to the function of the representative voltage-luminance characteristics. In other words, as shown in FIG. 18, the correction parameter calculation unit 52 calculates the second correction parameter (gain) for correcting such that the curve B indicating the voltage-luminance characteristics of the pixel unit 10 approaches the curve A indicating the representative voltage-luminance characteristics.

Specifically, the correction parameter calculation unit 52 first calculates a gain calculation voltage which is the voltage obtained in the case where the luminance when the pixel unit 10 is caused to emit light according to the predetermined signal voltage is inputted to the function of the representative voltage-luminance characteristics. As shown in FIG. 18, the correction parameter calculation unit 52 calculates a gain calculation voltage Vdata_hk which is the voltage obtained in the case where the luminance Lh when the pixel unit 10 is caused to emit light according to the predetermined signal voltage Vdata_h is inputted to the curve A.

Next, the correction parameter calculation unit 52 calculates the gain as the second correction parameter, using the predetermined signal voltage and the gain calculation voltage. Specifically, the correction parameter calculation unit 52 calculates a gain G according to the equation below, using the predetermined signal voltage Vdata_h and the gain calculation voltage Vdata_hk.

$$\Delta Vh = V\text{data_}hk - V\text{data_}h \quad \text{(Equation 1)}$$

$$G = \{1 - \Delta Vh/(V\text{data_}h + \Delta Vh)\} \quad \text{(Equation 2)}$$

In other words, the gain G is a numerical value showing the ratio of the predetermined signal voltage Vdata_h to the gain calculation voltage Vdata_hk.

It should be noted that the correction parameter calculation unit 52 may calculate the gain G using a method other than that described above, and may, for example, calculate the gain G by calculating ΔVh using (i) the luminance difference ΔLh between the luminance Lh and the standard luminance and (ii) a slope mh of the curve A shown in FIG. 18.

Subsequently, the correction parameter calculation unit 52 stores the gain, which is the second correction parameter, in the storage unit 43 included in the organic EL display device 40. Specifically, by outputting the second correction parameter to the control circuit 41, the control parameter calculation unit 52 causes the control circuit 41 to write the second correction parameter into the storage unit 43 and update the correction parameter table 43*a*.

With this, the process in which the correction parameter calculation unit 52 calculates the second correction parameter (S26 in FIG. 15) ends.

Figure 19:
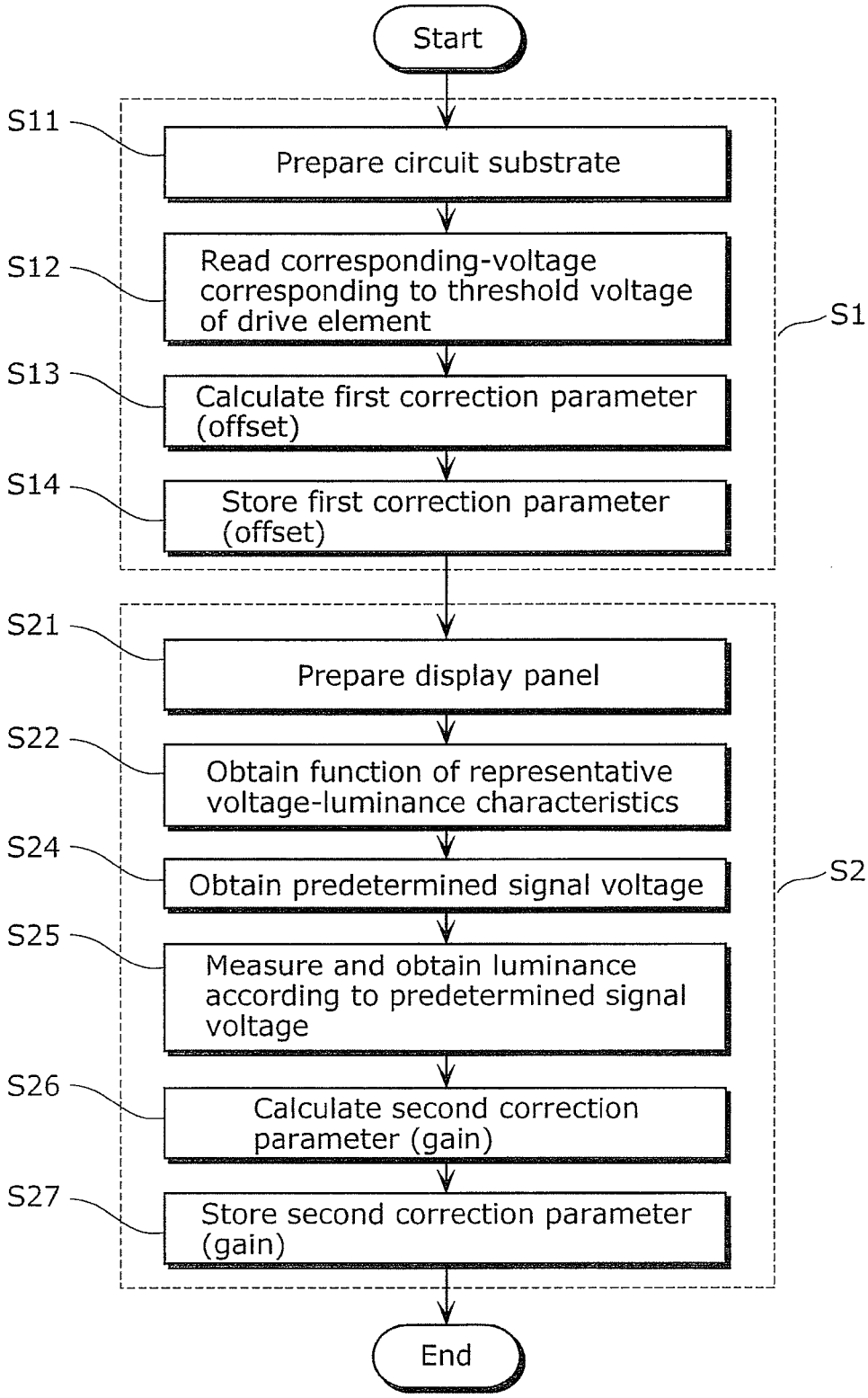
FIG. 19 is a flowchart showing the first correction parameter calculation process (S1) and a second parameter calculation process (S2)

Thus, according to the present invention, by performing the above described first correction parameter calculation process (S1) and the second correction parameter calculation process (S2) as shown in FIG. 19, it is possible to realize an organic EL display device and a manufacturing method thereof which can shorten the measuring tact, from when the luminance measurement for each pixel is performed up to when the correction parameter is obtained.

In this manner, according to the organic EL display device and the manufacturing method thereof according to the present invention, first, the holding capacitor Cs included in the pixel unit 10 is caused to hold the threshold voltage of the drive transistor T1, and the threshold voltage held by the holding capacitor Cs is obtained using the array tester 200. Then, the corresponding-voltage that corresponds to the obtained threshold voltage is stored, as the first correction parameter of the pixel unit 10, in the predetermined storage unit 43 used for the display panel 100. Although the above-described luminance difference in the low gradation-side affects the variation in the threshold voltage of the drive transistors T1, the luminance emitted by the respective pixel units 10 can be matched with the representative voltage-luminance characteristics in the low gradation region, by using the corresponding-voltage that corresponds to the threshold voltage as an offset (first correction parameter). Next, the predetermined voltage obtained by adding the first correction parameter to the signal voltage corresponding to one gradation level belonging to the intermediate gradation region or the high gradation region is calculated, and luminance measurement is performed for the first time by applying the predetermined voltage to the drive transistor T1 included in the pixel unit 10. More specifically, by adding the first correction parameter, which is the corresponding-voltage that corresponds to the threshold value of the drive transistor T1, to the signal voltage corresponding to the one gradation level belonging to the intermediate gradation region or the high gradation region, the luminance measurement in the intermediate gradation region or the high gradation region can be performed with the luminance in the low gradation region matching the representative voltage-luminance characteristics. Subsequently, the second correction parameter with which the luminance of the pixel unit 10 becomes the standard luminance obtained when the predetermined voltage is inputted to the function of the representative voltage-luminance characteristics is calculated for the pixel unit 10.

Therefore, as described above, the corresponding voltage that corresponds to the threshold voltage of the drive transistor T1 is read and used as the first correction parameter, and the luminance of the respective pixel units 10 in the high gradation region is matched with the luminance indicated by the representative voltage-luminance characteristics in the state where the luminance in the low gradation region matches the representative voltage-luminance characteristics. With this, the emitted luminance in the two gradation levels of the predetermined one gradation level belonging to the low gradation region and the predetermined one gradation level belonging to another gradation region can be made to match the representative voltage-luminance characteristics. As a result, since the luminance variation of the display panel 100 that is recognizable by the human eye can be suppressed and it is possible to arbitrarily select one gradation level on which to perform luminance measurement, it is possible to suppress luminance unevenness in a desired gradation region other than the low gradation region.

Furthermore, since the first correction parameter (offset) can be calculated in one measurement and the second correction parameter (gain) can be calculated in one luminance measurement, the first correction parameter and the second correction parameter can be calculated in a total of two measurements. As a result, the advantageous effect of being able to shorten measuring tact, from the performance of the luminance measurement for the respective pixel units 10 up to the calculation of the correction parameters (gain, offset) is produced.

(Modification)

Although the second correction parameter (gain) is determined for the pixel units 10 included in the display panel 100 in the above-described embodiment, the present invention is not limited to such. The display panel 100 may be divided into segments, and the second correction parameter (gain) may be determined for each of the segments.

Figure 20:
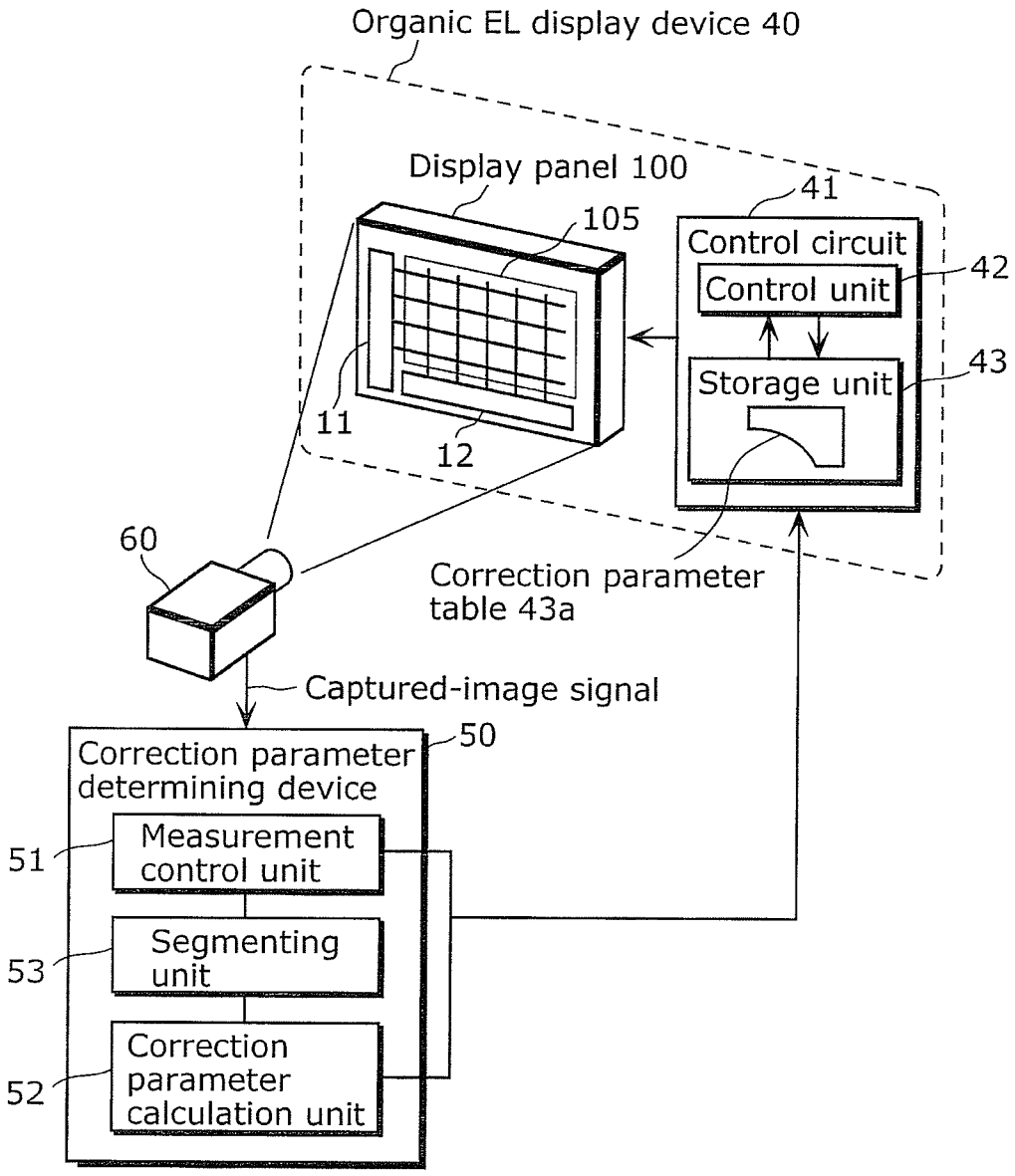
FIG. 20 is a diagram showing a configuration of a luminance measurement system at the time of luminance measurement of the display panel, according to a modification of the present embodiment.

FIG. 20 is a diagram showing a configuration of a luminance measurement system at the time of luminance measurement of a display panel according to a modification of the present embodiment. It should be noted that, since the control circuit 41, the display panel 100, and the measuring device 60 have the same functions as the control circuit 41, the display panel 100, and the measuring device 60 shown in FIG. 10, detailed description thereof shall be omitted.

The correction parameter determining device 50 includes a segmenting unit 53 aside from the measurement control unit 51 and the correction parameter calculation unit 52.

The segmenting unit 53 divides the display panel 100 into segments, and issues an instruction to the measurement control unit 51 and the correction parameter calculation unit 52 so that processing is performed on a per segment basis.

Following the instruction of the segmenting unit 53, the measurement control unit 51 obtains, on a per segment basis, the function of the representative voltage-luminance characteristics common among the pixel units 10 included in each of the segments.

Following the instruction of the segmenting unit 53, the correction parameter calculation unit 52 calculates the second correction parameter with which the luminance when a pixel unit 10 included in a segment measured by the measurement control unit 51 is caused to emit light according to the predetermined signal voltage becomes the standard voltage obtained when the predetermined signal voltage is inputted to the function of the representative voltage-luminance characteristics for the segment. Furthermore, following the instruction of the segmenting unit 53, the correction parameter calculation unit 52 calculates the second correction parameter with which the luminance when the pixel unit 10 included in a segment measured by the measurement control unit 51 is caused to emit light according to the predetermined signal voltage becomes the standard voltage obtained when the predetermined signal voltage is inputted to the function of the representative voltage-luminance characteristics for the segment.

Figure 21:
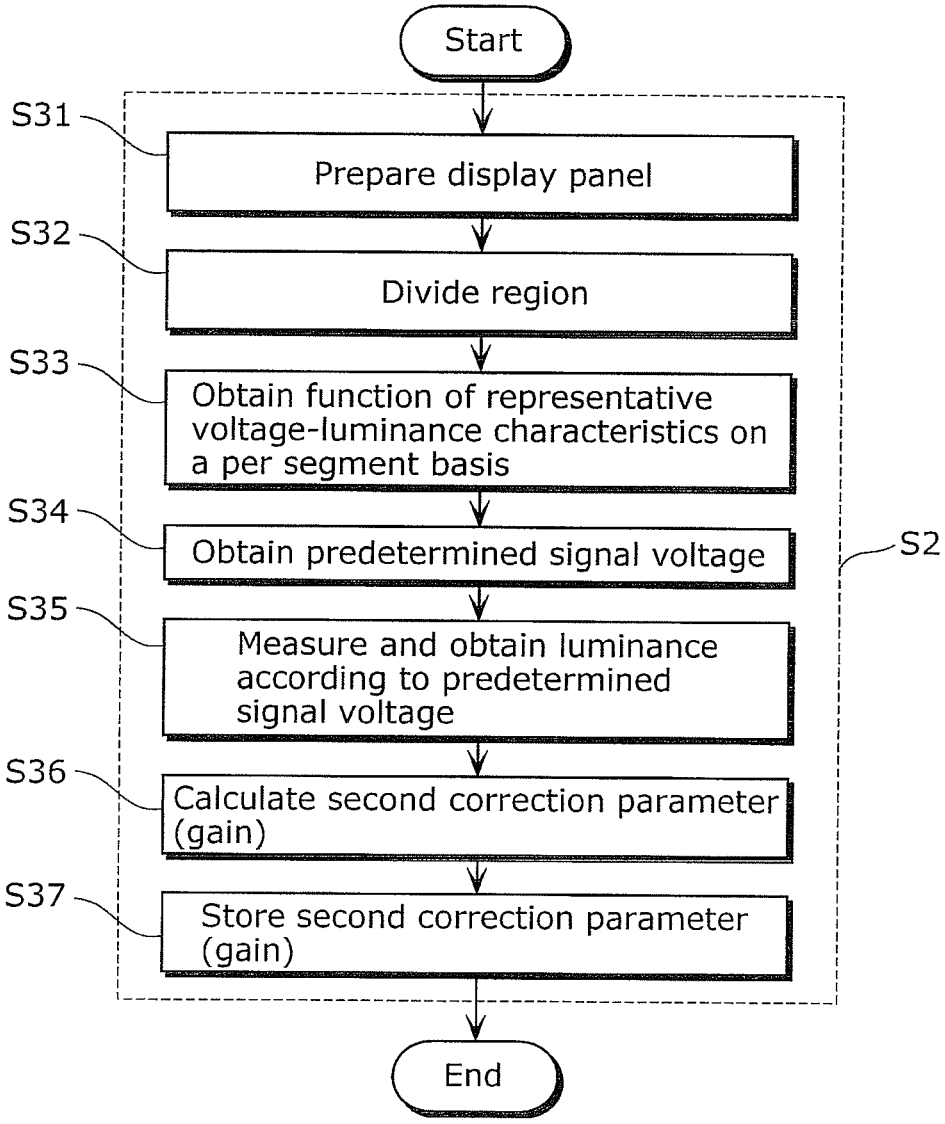
FIG. 21 is a flowchart showing an example of an operation by which a correction parameter determining device 50 determines the correction parameter, according to the modification of the present embodiment.

FIG. 21 is a flowchart showing an example of operation by which the correction parameter determining device 50 determines the correction parameter, according to the modification of the present embodiment.

First, the display panel 100 (organic EL display device 40) is prepared (S31). It should be noted that since details are the same as in S21 in FIG. 15, description shall be omitted.

Next, the segmenting unit 53 divides the display panel 100 into segments (S32). Here, although there is no particular limitation as to the number of segments into which the segmenting unit 53 divides the display panel 100, the segmenting unit 53, for example, divides the display panel 100 into 16 vertical×26 horizontal segments.

Next, the measurement control unit 51 obtains, for each of such segments, the function of the representative voltage-luminance characteristics common among the pixel units 10 included in each of the segments (S33).

Next, the measurement control unit 51 obtains the predetermined signal voltage (S34). It should be noted that, since details are the same as S24, description shall be omitted.

Next, the measurement control unit 51 measures and obtains, using the measuring device 60, the luminance according to the predetermined signal voltage for the pixel units 10 included in all of the segments (S35). Here, the measurement control unit 51 simultaneously obtains the luminance of the pixel units 10 by causing the pixel units 10 included in all of the segments to simultaneously emit light according to the predetermined signal voltage.

Next, the correction parameter calculation unit 52 calculates the second correction parameter (gain) for the pixel units 10 included in all of the segments (S36). In this manner, the correction parameter calculation unit 52 calculates, for the pixel unit 10, the correction parameter with which the luminance when the pixel unit 10 is caused to emit light according to the predetermined signal voltage becomes the luminance obtained when the predetermined signal voltage is inputted to the function of the representative voltage-luminance characteristics for the segment including the pixel unit 10.

Subsequently, the correction parameter calculation unit 52 stores the calculated second correction parameter (gain) in the storage unit 43, in association with the pixel unit 10 (S37).

In this manner, the display panel 100 is divided into segments, and the representative voltage-luminance characteristics common among the pixel units 10 included in each of the segments is set on a per segment basis. Then, the correction parameter calculation unit 52 calculates the second correction parameter with which the luminance when the pixel unit 10 is caused to emit light according to the predetermined signal voltage becomes the luminance obtained when the predetermined signal voltage is inputted to the function of the representative voltage-luminance characteristics for the segment including the pixel unit 10. With this, it is possible, for example, to correct only a segment in which luminance unevenness occurs because luminance change between adjacent pixels is severe, and thus it is possible to calculate a second correction parameter with which the luminance change between the adjacent pixels becomes smooth.

Although the organic EL display device manufacturing method and the organic EL display device according to the present invention have been described based on an embodiment, the present invention is not limited to such embodiment. Various modifications of the exemplary embodiment as well as embodiments resulting from arbitrary combinations of constituent elements of different exemplary embodiments that may be conceived by those skilled in the art are intended to be included within the scope of the present invention as long as these do not depart from the essence of the present invention.

INDUSTRIAL APPLICABILITY

The present invention is particularly useful as method of manufacturing an organic EL flat-panel display in which an organic EL display device is built into, and is most suitable for use as a method of manufacturing an organic EL display device that can reduce luminance unevenness in a display panel while reducing measuring time.

What is claimed is:

1. A method of manufacturing an organic electroluminescence display, the organic electroluminescence display including a display panel and storing a correction parameter in a storage used for the display panel, the method comprising:

preparing a substrate including pixels, each of the pixels including:

a driver that is voltage driven and includes a gate, a source, and a drain; and a capacitor that includes a first electrode connected to the gate and a second electrode connected to one of the source and the drain;

causing the capacitor included in a subject pixel to hold a corresponding voltage which corresponds to a threshold voltage of the driver, and reading the corresponding voltage held by the capacitor included in the subject pixel with a first measurer, the subject pixel being one of the pixels to be processed;

storing the corresponding voltage as a first correction parameter of the subject pixel in the storage using the first measurer;

preparing the display panel including the substrate and light-emitters by which the pixels emit light according to a drive current of the driver of each of the pixels;

obtaining representative voltage-luminance characteristics common among the pixels;

obtaining a first signal voltage by adding the first correction parameter of the subject pixel to a second signal voltage corresponding to a single gradation level belonging to one of an intermediate gradation region and a high gradation region of the representative voltage-luminance characteristics;

applying the first signal voltage to the driver included in the subject pixel, and measuring a luminance emitted by the subject pixel with a second measurer;

calculating a second correction parameter with which the luminance emitted by the subject pixel becomes a standard luminance, the standard luminance being obtained when the first signal voltage is input to a function of the representative voltage-luminance characteristics; and storing the second correction parameter in the storage in association with the subject pixel, wherein, when calculating the second correction parameter, a gain calculation voltage is calculated such that the luminance emitted by the subject pixel is the standard luminance, and the second correction parameter is a gain indicating a ratio between the first signal voltage and the gain calculation voltage.

2. The method according to claim 1, wherein the second electrode of the capacitor is connected to the source of the driver, each of the pixels further includes:

a first power line for supplying a potential of the drain of the driver;

a second power line connected to an electrode of a corresponding one of the light emitters;

a third power line for supplying a first standard voltage that defines a voltage value of the first electrode of the capacitor;

a data line for supplying a second standard voltage that is less than a difference of the first standard voltage minus the threshold voltage of the driver;

a first switch for switchedly interconnecting the first electrode of the capacitor and the third power line;

a second switch for switchedly interconnecting the data line and the second electrode of the capacitor; and a third switch for switchedly interconnecting the source of the driver and the second electrode of the capacitor, and when causing the capacitor included in the subject pixel to hold the corresponding voltage:

a potential difference that is larger than the threshold voltage of the driver is generated in the capacitor by placing the first switch in a first ON state to apply the first standard voltage to the first electrode of the capacitor, and placing the second switch in a second ON state to apply the second standard voltage to the second electrode of the capacitor; and the capacitor is caused to hold the corresponding voltage that corresponds to the threshold voltage by waiting until the potential difference in the capacitor is the threshold voltage of the driver and the driver turns OFF.

3. The method according to claim 2, wherein the first power line and the third power line are a common power line.

4. The method according to claim 1, wherein the display panel is prepared in place of preparing the substrate.

5. The method according to claim 4, wherein, when causing the capacitor included in the subject pixel to hold the corresponding voltage, a first standard voltage is supplied to the capacitor and the first standard voltage is set so that a potential difference between electrodes of a light-emitter of the subject pixel is less than a threshold voltage of the light-emitter at which the light-emitter emits light.

6. The method according to claim 1, wherein, when causing the capacitor included in the subject pixel to hold the corresponding voltage:

a current corresponding to the corresponding voltage is supplied from the second electrode of the capacitor to a data line, by placing a second switch that switchedly interconnects the second electrode of the capacitor and the data line in an ON state after causing the capacitor to hold the corresponding voltage that corresponds to the threshold voltage; and the corresponding voltage held by the capacitor is read by measuring, with the first measurer, the current supplied to the data line.

7. The method according to claim 1, wherein the corresponding voltage that corresponds to the threshold voltage is proportional to the threshold voltage of the driver and smaller than the threshold voltage of the driver.

8. The method according to claim 1, wherein the second signal voltage corresponds to the single gradation level belonging to the high gradation region of the representative voltage-luminance characteristics and is from approximately 20% to approximately 100% of a maximum gradation level that is displayable by each of the pixels.

9. The method according to claim 1, wherein the second signal voltage corresponds to the single gradation level belonging to the high gradation region of the representative voltage-luminance characteristics and is approximately 30% of a maximum gradation level that is displayable by each of the pixels.

10. The method according to claim 1, wherein the signal voltage corresponds to the single gradation level belonging to the intermediate gradation region of the representative voltage-luminance characteristics and is approximately 10% to approximately 20% of a maximum gradation level that is displayable by each of the pixels.

11. The method according to claim 1, wherein the representative voltage-luminance characteristics are voltage-luminescence characteristics of a predetermined single pixel of the pixels included in the display panel.

12. The method according to claim 1, wherein the representative voltage-luminance characteristics are characteristics obtained by averaging voltage-luminescence characteristics of at least two pixels of the pixels included in the display panel.

13. The method according to claim 1, wherein, when obtaining the representative voltage-luminance characteristics, the display panel is divided into segments, and the representative voltage-luminance characteristics are obtained for each of the segments, the representative voltage-luminance characteristics being common among ones of the pixels included in each of the segments, and when calculating the second correction parameter, the second correction parameter with which the luminance emitted by the subject pixel becomes the standard luminance is calculated for the subject pixel with the standard luminance being obtained when the first signal voltage is input to the function of the representative voltage-luminance characteristics for the segment including the subject pixel.

14. The method according to claim 1, wherein the first measurer is an array tester.

15. The method according to claim 1, wherein the second measurer is an image sensor.

16. An organic electroluminescence element, comprising:

a display panel including pixels, each of the pixels including:

a light-emitter, a driver including a gate, a source, and a drain, the driver being voltage-driven and controlling a supply of current to the light-emitter; and a capacitor including a first electrode connected to the gate and a second electrode connected to one of the source and the drain;

a storage configured to store a correction parameter for each of the pixels for correcting, in accordance with characteristics of the pixels, an image signal inputted from an external source; and a controller configured to obtain, for each pixel of the pixels, a corrected signal voltage by reading the correction parameter corresponding to the pixel from the storage and calculating the corrected signal voltage from the image signal corresponding to the pixel using the correction parameter read from the storage, wherein the correction parameter is generated by:

causing the capacitor included in a subject pixel to hold a corresponding voltage which corresponds to a threshold voltage of the driver, and reading the corresponding voltage held by the capacitor included in the subject pixel with a first measurer, the subject pixel being one of the pixels to be processed;

storing the corresponding voltage as a first correction parameter of the subject pixel in the storage using the first measurer;

obtaining representative voltage-luminance characteristics common among the pixels included in the display panel;

obtaining a first signal voltage by adding the first correction parameter of the subject pixel to a second signal voltage corresponding to a single gradation level belonging to one of an intermediate gradation region and a high gradation region of the representative voltage-luminance characteristics;

applying the first signal voltage to the driver included in the subject pixel, and measuring a luminance emitted by the subject pixel with a second measurer;

calculating a second correction parameter with which the luminance emitted by the subject pixel becomes a standard luminance, the standard luminance being obtained when the first signal voltage is input to a function of the representative voltage-luminance characteristics; and storing the second correction parameter in the storage in association with the subject pixel, when calculating the second correction parameter, a gain calculation voltage is calculated such that the luminance emitted by the subject pixel is the standard luminance, and the second correction parameter is a gain indicating a ratio between the first signal voltage and the gain calculation voltage.

* * * * *